US006173806B1

(12) United States Patent
Ito

(10) Patent No.: US 6,173,806 B1
(45) Date of Patent: Jan. 16, 2001

(54) MUFFLING WALL

(75) Inventor: Sadakuni Ito, Miyagi (JP)

(73) Assignee: Itoon, Sendai (JP)

( * ) Notice: Under 35 U.S.C. 154(b), the term of this patent shall be extended for 0 days.

(21) Appl. No.: 09/269,760

(22) PCT Filed: Oct. 8, 1997

(86) PCT No.: PCT/JP97/03627

§ 371 Date: Apr. 8, 1999

§ 102(e) Date: Apr. 8, 1999

(87) PCT Pub. No.: WO98/15943

PCT Pub. Date: Apr. 16, 1998

(30) Foreign Application Priority Data

Oct. 9, 1996 (JP) ..... 8-287475
May 9, 1997 (JP) ..... 9-135810

(51) Int. Cl.[7] ..... E04H 17/00

(52) U.S. Cl. ..... 181/210; 181/206; 181/209; 181/295

(58) Field of Search ..... 181/210, 207, 181/209, 217, 218, 206, 284, 286, 287, 290, 295

(56) References Cited

U.S. PATENT DOCUMENTS 5,971,096 * 10/1999 Matsumoto et al. ..... 181/210

FOREIGN PATENT DOCUMENTS 62-266012 * 11/1987 (JP) .

* cited by examiner

*Primary Examiner*—Khanh Dang
(74) *Attorney, Agent, or Firm*—Oblon, Spivak, McClelland, Maier & Neustadt, P.C.

(57) ABSTRACT

This invention provides a muffling panel of a new-type lightweight construction having a function of effectively excluding sounds in low and medium sound ranges and high muffling and sound-absorbing properties in a relatively low frequency band area, and also having at least two parallel diaphragms, a frame body for fixing of the diaphragms and a vibration transmitting mechanism which links to the diaphragms and can mechanically transmit reverse phase vibration, wherein the vibration transmitting mechanism converts vibration of one of the diaphragms which vibrates when receiving a sound into reverse phase vibration thereof to transmit it to the other of the diaphragms, thus causing the other of the diaphragms to displace inward or outward and vibrate simultaneously with one of the diaphragms according to vibration energy of the above original sound.

9 Claims, 27 Drawing Sheets

MUFFLING WALL

BACKGROUND OF THE INVENTION

1. Field of the Invention

The present invention relates to a newtype of muffling panel capable of damping and absorbing sound in low to medium sound ranges. More specifically, the present invention relates to a muffling panel of lightweight construction having a function of effectively excluding at a high level a sound in low sound and medium sound ranges in particular, which is useful in the walls and floors of buildings, sound absorbing walls in hallways, sound insulating walls along railroad tracks/expressways, soundproofing walls for machinery and engine rooms, and noise eliminators (mufflers) for internal combustion engines and the like.

2. Description of the Related Art

In general, thick walls made of a material with a large mass are required to isolate low sounds, and low and medium sounds of high sound volume, and up to this time, concrete walls, as well as steel, aluminum and other metal walls provided on the inside thereof with sound absorbing materials have often been used. However, walls of so-called heavy construction such as this type of walls are costly to manufacture, and also require considerable time and efforts to construct the same. Further, in the past, some attempts were also made to isolate sound by using a electrically produced reverse-phase sound, but this approach has drawbacks, such as problems of electric power to be consumed proportional to sound volume, complicated equipment to be constructed, and high costs for manufacturing thereof, and therefore, it never achieved widespread general use.

Under these circumstances, the present inventor, as a result of cumulative diligent research, having as an object the development of a new-type muffling panel of lightweight construction, having a simple construction, being inexpensive to manufacture, and having excellent muffling and sound-absorbing properties across a wide frequency band area, and being capable of effectively isolating sound in low sound and medium sound ranges in particular, has completed the present invention by successfully developing the below-described muffling panel of a completely new construction.

SUMMARY OF THE INVENTION

The present invention has as an object providing a new-type muffling panel of lightweight construction, having a function of effectively isolating sounds in low sound and medium sound ranges.

The present invention relates to a muffling panel having high muffling and sound-absorbing properties in a relatively low frequency band area, and relates to a muffling panel characterized in that it comprises, at the least, two opposing diaphragms, a frame body for affixing these diaphragms, and a mechanical type opposite (reverse) phase vibration transmitting mechanism for linking these diaphragms so they communicate with one another, and the above-mentioned vibration transmitting mechanism is constituted so as to transmit the vibration of a diaphragm of the one side, which vibrates upon receiving a sound, to a diaphragm of the other side by mechanically changing same to an opposite (reverse) phase vibration, thus causing the diaphragm of the other side to displace inward or outward, and vibrate simultaneously with the diaphragm of the one side in accordance with the above-mentioned original sound vibration energy.

The present invention has as an object providing a new-type muffling panel of a lightweight construction, having high muffling and sound-absorbing properties in a relatively low frequency band area, and having a function of effectively isolating at a high level sounds in low sound and medium sound ranges in particular.

Further, the present invention has as an object providing a muffling panel of lightweight construction, which is useful in the walls and floors of buildings, sound absorbing walls in hallways, sound insulating walls along railroad tracks/expressways, soundproofing walls for machinery and engine rooms, and noise eliminators (mufflers) for internal combustion engines and the like.

Furthermore, the present invention has as an object providing a muffling panel of lightweight construction, having a simple structure, being inexpensive to manufacture, and being capable of installing in a short period time.

The present invention, which solves for the above-mentioned subjects, comprises the following technical means.

(1) A muffling panel of lightweight construction, having high muffling and sound-absorbing properties in a relatively low frequency band area, which comprises, at the least, the following members:

(a) two opposing diaphragms;

(b) a frame body for affixing these diaphragms; and (c) a mechanical type opposite phase vibration transmitting mechanism for linking these diaphragms so they communicate with one another, wherein said vibration transmitting mechanism is constituted so as to transmit a vibration of a diaphragm of the one side, which vibrates upon receiving a sound, to a diaphragm of the other side by mechanically changing same to an opposite (reverse) phase vibration to cause the diaphragm of the other side to displace inward or outward, and vibrate simultaneously with the diaphragm of the one side in accordance with said original sound vibration energy.

(2) The muffling panel of (1) above, wherein the vibration transmitting mechanism comprises an apparatus (transmitter), which is supported in the middle in a freely rotating manner at a fixed point between two diaphragms, and each end thereof is linked to a corresponding diaphragm.

(3) The muffling panel of (2) above, wherein said transmitter comprises an oscillating link and secondary links, the oscillating link is supported in the middle in a freely rotating manner at a fixed point between two diaphragms, the secondary links are hinged, respectively, to both ends of this oscillating link, and the end of this secondary link is linked to a corresponding diaphragm.

(4) The muffling panel of (3) above, wherein said secondary link comprises a filament body, both ends of said oscillating link are connected to corresponding diaphragms via this filament body, and this oscillating link is biased by a bias spring so as to apply tensile force to this filament body.

(5) The muffling panel of (1) or (2) above, wherein the frame body comprises a grate having a plurality of compartments, a diaphragm is affixed to both sides of this grate, two opposing diaphragms are formed in each compartment, and the vibration transmitting mechanism links a diaphragm of one side of one of the compartments of the grate to a diaphragm of the other side of an adjacent compartment so they communicate with one another.

(6) The muffling panel of (2) above, wherein said transmitter comprises at least two main links, which are hinged together and are linked at each end thereof to a corresponding diaphragm, and at least two secondary links, each end of which is hinged to a midpoint of a corresponding main link, and these main links and secondary links act in concert, constituting parallel links.

(7) The muffling panel of (1) or (2) above, wherein two diaphragms formed in the shape of trumpets are mounted to the opening portions of both sides of a box body, which is partitioned in the middle by a partitioning panel.

(8) The muffling panel of (1) above, wherein the vibration transmitting mechanism comprises two pistons-cylinders, the insides of which are filled with fluid, and the piston, which fits into each cylinder, is connected to a corresponding diaphragm, and both cylinders are linked together so that when the piston of one side moves, the piston of the other side moves in the opposite direction.

(9) A muffling panel of lightweight construction, having high muffling properties in a relatively low frequency band area, which comprises two diaphragms characterized in that a side edge of each of two diaphragms is supported on a spindle in a freely rotating manner, and furthermore, a diaphragm that moves in unison with these diaphragms is provided so as to extend on the opposite side thereof with this spindle in between, and, as needed, a partitioning panel is formed between said two diaphragms.

More detailed descriptions of the present invention are provided below.

The muffling panel of the present invention is comprised basically of 2 diaphragms that are arranged panel to one another, a frame body for affixing such diaphragms, and a mechanical-type opposite (reverse) phase vibration transmitting mechanism (referred to in this specification as a vibration transmitting mechanism) for linking these diaphragms so they communicate with one another. And the greatest characteristic thereof is the fact that the above-mentioned vibration transmitting mechanism is constituted so as to transmit the vibration of a diaphragm of the one side, which vibrates upon receiving a sound, to a diaphragm of the other side by mechanically changing same to an opposite (reverse) phase vibration, thus causing the diaphragm of the other side to displace inward or outward, and vibrate simultaneously with the diaphragm of the one side in accordance with the above-mentioned original sound vibration energy. When a diaphragm on one side facing a sound source is subjected to a sound and vibrates, this vibration transmitting mechanism has a function for mechanically changing this vibration to an opposite (reverse) phase of same and transmitting it to a diaphragm on the other side. By utilizing the above-mentioned vibration transmitting mechanism, since a sound that passes through a diaphragm on the sound source side, and a sound that gives rise to the vibration of a diaphragm on the opposite side of the sound source can be made opposite (reverse) phase, a remarkable muffling and sound-absorbing effect can be achieved resulting from the mutual negating action thereof.

The muffling panel of the present invention has high muffling and sound-absorbing properties in a relatively low frequency band area, and exhibits a remarkable muffling and sound-absorbing effect, particularly for sounds in low sound and medium sound ranges, which generate great vibration. Because the amplitude of a diaphragm becomes smaller when a sound becomes higher, even for a sound of the same intensity, muffling performance drops by that much. Further, as a sound becomes higher, that is, as the wavelength becomes shorter, the spacing of two diaphragms cannot be ignored. That is, even if there is a variance of phase of 180 degrees between the vibrations of two diaphragms, because the phase of a sound passing through a diaphragm on the one side will vary to that degree during transmission to a diaphragm on the other side, muffling performance will decline by that much.

Therefore, the spacing of two diaphragms in the present invention must be made sufficiently smaller than the wavelength of a sound to be muffled, and in accordance thereto, a muffling and sound-absorbing effect can be achieved even in a high frequency band. Further, to enhance muffling and sound-absorbing properties thereof for a higher frequency sound, it is necessary to make a diaphragm more lightweight so that it can also vibrate at higher sounds. Furthermore, the above-mentioned vibration transmitting mechanism must also be made more lightweight so that it is capable of responding to the number of vibrations of a sound of a higher sound range.

The two diaphragms used in a muffling panel of the present invention need not be a heavy material like concrete and steel plating and the like. A light material, such as, for example, plywood, plastic boards, paper, plastic film, lightweight metal boards, such as thin aluminum sheeting, or a composite material comprising these materials, can be used preferably in accordance with the circumstances.

The above-mentioned two diaphragms need not be of the same material, and the above-mentioned materials can also be used in combination in accordance with the circumstances. Furthermore, it is also possible to use an above-mentioned heavy material on one side, and an above-mentioned light material on the other side as circumstances dictate.

Further, as described above, the muffling panel of this invention converts vibration of one of the diaphragms into reverse phase vibration thereof to transmit it to the other of the diaphragms, thus causing the other of the diaphragms to displace inwardly or outwardly and to vibrate simultaneously with one of the diaphragms according to vibration energy of the above original sound. Therefore, the vibration that has passed through the diaphragm on the side of the sound source and the vibration of the diaphragm on the opposite side of the sound source canel out each other because they are in reverse phases, thus producing an effect removing the vibration based on the vibration energy.

The vibration transmitting mechanism utilized in a muffling panel of the present invention is characterized in that it has a structure wherein two diaphragms, which are arranged parallel to one another in a specific manner, are linked mechanically, and in that it has a function, whereby, when a diaphragm on the one side displaces and vibrates upon receiving a sound in an inward or outward direction, for a process in which the diaphragm on the one side moves inward, the diaphragm on the other side is made to move inward, and conversely, for a process in which the same moves outward, the diaphragm on the other side is made to move outward.

If the above-mentioned vibration transmitting mechanism (hereinafter referred to as a muffling mechanism) has a function for mechanically changing the vibration of a diaphragm on the one side to the opposite (reverse) phase of same, and transmitting this vibration to a diaphragm on the other side, then any structure thereof is acceptable, and the structure thereof not being particularly limited.

As a typical example of this vibration transmitting mechanism, for example, a mechanism that treats as a constituent element an apparatus, which is supported in the middle in a freely rotating manner at a fixed point between two diaphragms, and which is connected at each end to a corresponding diaphragm, is exemplified as the preferable one (hereinafter called a transmitter).

In this case, it is possible to use a suitable member as a secondary apparatus in addition to the above-mentioned constituent element. When a diaphragm on the one side is subjected to a sound and vibrates, this transmitter has a function for oscillating in accordance thereto, and transmitting a vibration to a diaphragm on the other side. Because this transmitter is supported at the fixed point in the middle in a freely rotating manner, the phase of the movement at each end thereof is opposite (reverse). Therefore, the diaphragm on the side opposite to the sound source is oscillated by the above-described transmitter at the opposite (reverse) phase of the diaphragm on the sound source side, and a high muffling effect is achieved by the negating action between the sound generated therefrom and the sound passing through the panel.

The above-described transmitter can be linked directly to a diaphragm, or a transmitter can, according to circumstances, be constituted of an oscillating link and a secondary link by providing a secondary link therebetween.

That is, a secondary link is hinged by a pin or the like to each end of the oscillating link, and each end of this secondary link is linked to a corresponding diaphragm. By providing secondary links like this, the positions of the linkage points of the transmitter and two diaphragms can be positioned along the same straight line perpendicular to the diaphragms. In this case, because the vibration mode of the two diaphragms is exactly opposite (reverse), a remarkable muffling and sound-absorbing effect is achieved.

Further, instead of a secondary link like this, each end of the above-mentioned oscillating link can be connected to a diaphragm by a filament body, and a bias spring can be used to bias the oscillating link to rotate, thereby applying tensile force to the filament body. Since this means enables the sag in a diaphragm to be removed by the bias spring, it is especially useful when a diaphragm is thin and tends to sag.

Further, it is also possible to constitute a transmitter using parallel links. That is, a good example can be given, wherein parallel links comprise at least two main links, which, for example, are hinged to one another by pins or the like, and the ends of each are linked to corresponding diaphragms, and at least two secondary links, which are supported in a freely rotating manner at a fixed point between two diaphragms, and the ends of each are hinged to midpoints of corresponding main links, and these main links and secondary links work in concert, constituting parallel links.

By adopting a parallel link structure like this, the positions of the linkage points of the transmitter and two diaphragms can be positioned along the same straight line perpendicular to the diaphragms. In this case, because the vibration mode of the two diaphragms is exactly opposite (reverse), a remarkable muffling and sound-absorbing effect is achieved.

Furthermore, a vibration transmitting mechanism can be constituted by combining two piston cylinders, the insides of which are filled with a fluid (a liquid, gas or the like). The two cylinders are connected so that when one of the pistons moves, the other pistons moves in the opposite direction. In accordance therewith, it is possible to achieve the same muffling and sound-absorbing effect.

Next, the shape, structure of a diaphragm can be suitably changed in accordance with a utilization objective or the like, and are not particularly limited.

For example, forming a diaphragm in the shape of a trumpet, like the cone paper of a speaker, and attaching this to opening portions on both sides of a box body, which is partitioned in the middle by a partitioning panel, is also possible in accordance with circumstances. By adopting a constitution like this, since the box body stabilizes the vibration of the trumpet-shaped diaphragms, and more particularly, can effectively reproduce an opposite (reverse) phase low sound, a high muffling and sound-absorbing effect is achieved for sounds in a low sound range in particular.

Next, modes for combining a vibration transmitting mechanism, a diaphragm, and a frame body can be suitably changed in accordance with a utilization objective or the like. Further, the shape, structure of a frame body is also not particularly limited. For example, it is also possible to form two diaphragms by stretching a diaphragm which is comprising a membrane body on both sides of a lattice or grate having a plurality of compartments, and forming two diaphragms that oppose one another in each compartment in accordance with circumstances. In this case, it is possible to use a structure, wherein the vibration transmitting mechanism passes through a hole formed in the grate partition, and links a diaphragm on one side of one compartment of the grate to a diaphragm on the other side of an adjacent compartment.

In accordance with this mode, since a plurality of vibration transmitting mechanisms can be incorporated into a single muffling panel, a high level muffling and sound-absorbing effect is achieved. Further, since each vibration transmitting mechanism is directly supported by the grate, the structure can be simplified, standardization and unitization of the muffling mechanism are facilitated, and manufacturing costs can be lowered.

Next, as a muffling panel of a lightweight construction, having high muffling and sound-absorbing properties in a relatively low frequency band area, which differs from those described above, an example is given of a muffling panel, which is characterized in that a side edge of each of two diaphragms is supported on a spindle in a freely rotating manner, and furthermore, a diaphragm that moves in unison with these diaphragms is provided so as to extend on the opposite side thereof with this spindle in between, and, as needed, a partitioning panel is formed between the above-mentioned two diaphragms.

When a diaphragm on the sound source side vibrates, this structure creates a muffling interaction by vibrating a diaphragm on the opposite side at the opposite phase, making it possible to expect a high muffling and sound-absorbing effect despite the simplicity of the structure.

With the present invention, the above-mentioned two diaphragms can be used as they are, but to protect the diaphragm surface, as needed, a protective plate, protective metallic mesh or other protective member can be mounted to a diaphragm as an appropriate means. As this protective member, for example, a sheet of wood or metal, a gypsum panel, outer wall materials for construction use, or composites thereof are preferably exemplified.

Further, with the present invention, a partitioning panel of an aspect that accords with circumstances can be installed between the above-mentioned two diaphragms. As this partitioning panel, a sheet of wood, metal, rubber, plastic or a similar resin, or one of same, which has sponge or some other sound absorbing material applied thereto, are exemplified as preferable one, but it is not limited thereto, making it possible to use a material in accordance with the circumstances. By providing the above-mentioned partitioning panel, it is possible to muffle and exclude a sound in a high frequency band area.

Modes of utilization of a muffling panel of the present invention are described below.

A muffling panel of the present invention is preferably utilized as a partitioning wall in a structure and a building, for example. In this case, this muffling panel is installed, for example, between the floor board of a room on one floor and the ceiling of a room on the floor therebelow, but usage thereof is not limited thereto, and it can be installed in a manner, whereby a floor and a ceiling are treated as two diaphragms, and similarly, it can be installed in a manner, whereby a wall is linked to a wall, or some such manner that accords with circumstances. In this case, one and/or the other of two diaphragms can also be constituted as a portion or an entire wall material/floor material. In accordance therewith, for example, low-frequency-band footsteps or the like on the above floor can be prevented from reverberating on the floor below.

Further, a muffling panel of the present invention is used, for example, by installing it like a screen/wall around a source of sound.

A conventional concrete wall is characterized in that it entirely encloses a sound source or space to be soundproofed, and muffles sound in a manner in which sound is contained. Therefore, if there is a crack in a wall, the soundproofing effect is markedly reduced.

A muffling panel of the present invention does not contain sound, but rather uses an opposite (reverse) phase sound to negate a sound passing through a panel.

Therefore, it is not necessary to enclose a sound source. Simply setting up a screen around a source of noise, for example, can achieve a dramatic muffling and sound-absorbing effect.

Further, a soundproof wall of a heavy construction, such as conventional concrete, uses mass to suppress sound vibrations, but the larger the surface area of a wall subjected to a sound, the more readily the sound vibration is transmitted, and to stop the vibration thereof, further increasing the thickness of the wall is considered necessary.

As for a muffling panel of the present invention, since the muffling effect does not degrade even if the area of the panel subjected to the sound becomes larger, it can be suitable for use even in walls with a large surface area.

As described above, a muffling panel of lightweight construction of the present invention has a simple structure, is inexpensive to manufacture, and can be installed in a short period of time.

A muffling panel of the present invention is useful as a muffling wall in the partitioning walls and floors of structures and buildings, sound absorbing walls in hallways, sound insulating walls along railroad tracks/expressways, soundproofing walls for machinery and engine rooms, and in noise eliminators (mufflers) for internal combustion engines and the like.

Further, as described above, the muffling panel of this invention converts vibration of one of the diaphragms into reverse phase vibration thereof to transmit it to the other of the diaphragms, thus causing the other of the diaphragms to displace inwardly or outwardly and to vibrate simultaneously with one of the diaphragms according to vibration energy of the above original sound. Therefore, the vibration that has passed through the diaphragm on the side of the sound source and the vibration of the diaphragm on the opposite side of the sound source canel out each other because they are in reverse phases, thus producing an effect removing the vibration based on the vibration energy.

The biggest feature of a muffling panel of the present invention is the fact that it has the above-described muffling mechanism, and if there is an artifact which utilizes the above-described muffling mechanism, it is included in the scope of the present invention regardless of the type of product involved.

DETAILED DESCRIPTION OF THE PREFERRED EMBODIMENTS

Next, the outstanding muffling properties of a muffling panel of the present invention are described by presenting a test example thereof.

Test Example (1) Method

As the muffling panel, a muffling panel (having a unit of a muffling mechanism), comprising the below-described muffling mechanism shown in the FIG. 6, was utilized. The frame was made of wood, and the diaphragms were made of 2 mm thick woodlac (paper boards with urethane sandwiched therebetween). The muffling properties thereof were investigated by emitting via a speaker located on one side of the muffling panel a 100 dB sound generated from an oscillating apparatus, and measuring the transmitted sound (sound pressure level) via a measuring apparatus located 50 cm on the opposite side of the muffling panel.

As a control, a panel, comprising just a frame and diaphragms, which did not have a muffling mechanism of the present invention inside (having no unit), was used, and the test was carried out in the same manner as described above.

(2) Results

Figure 25:
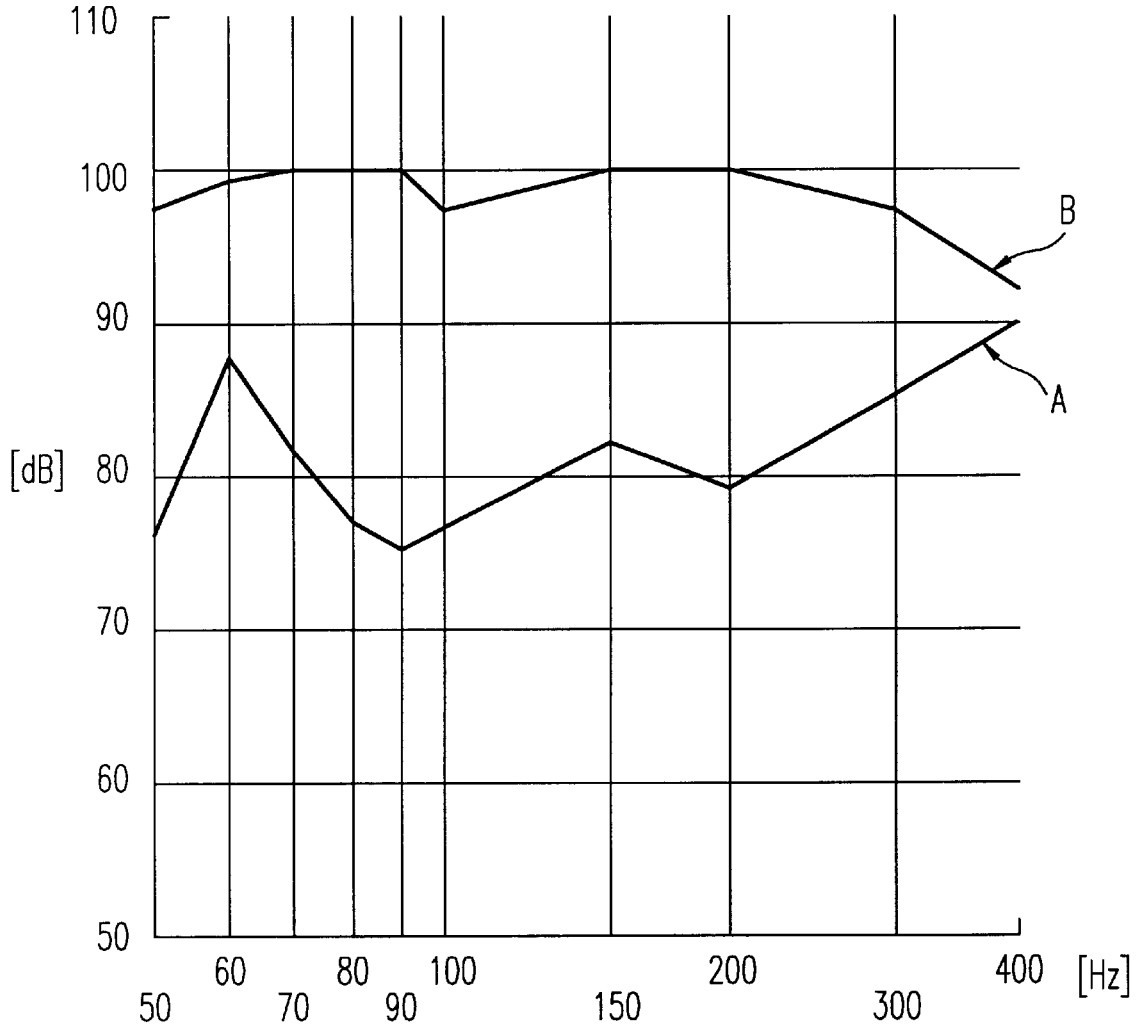
FIG. 25 shows the results of measuring a sound pressure level (sine wave) of a test example.
Figure 26:
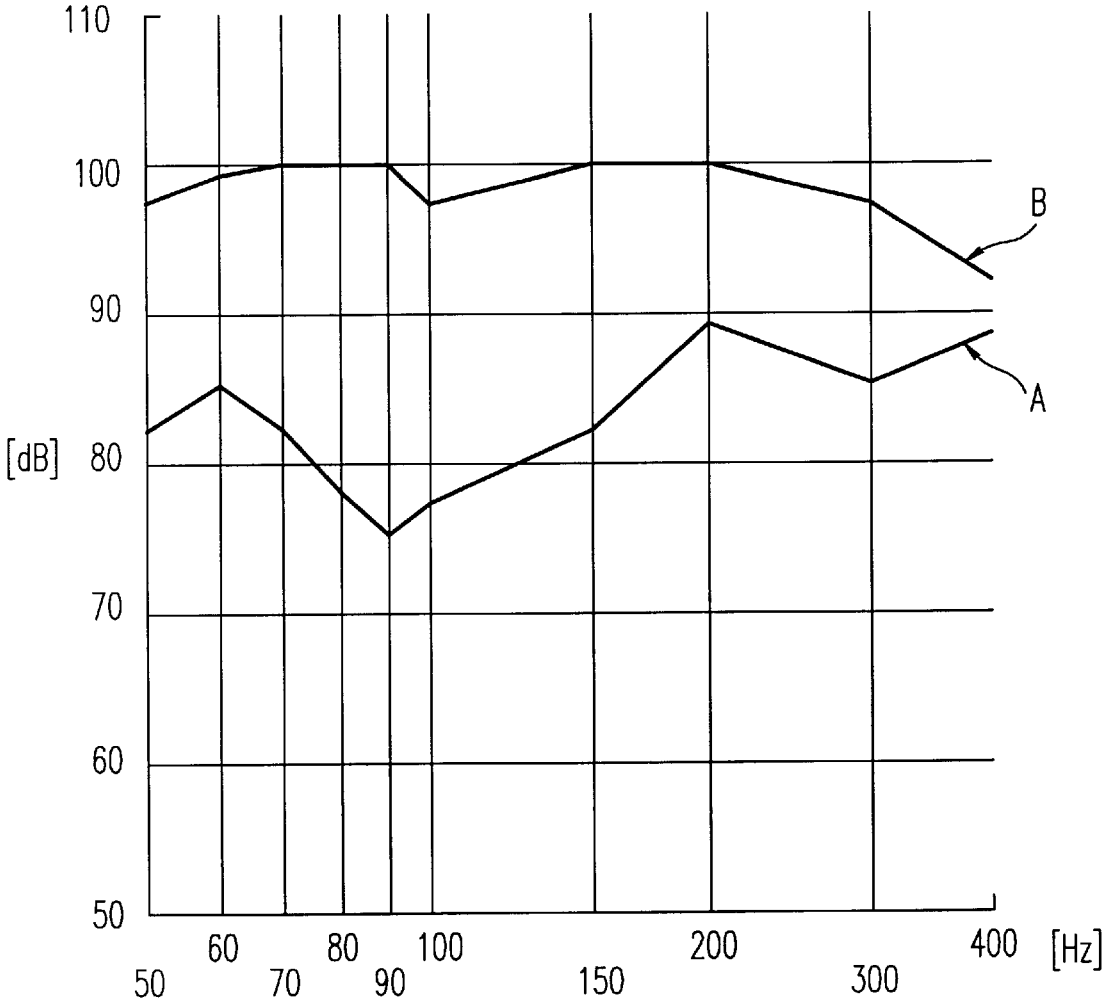
FIG. 26 shows the results of measuring a sound pressure level (sawtooth wave) of a test example.
Figure 27:
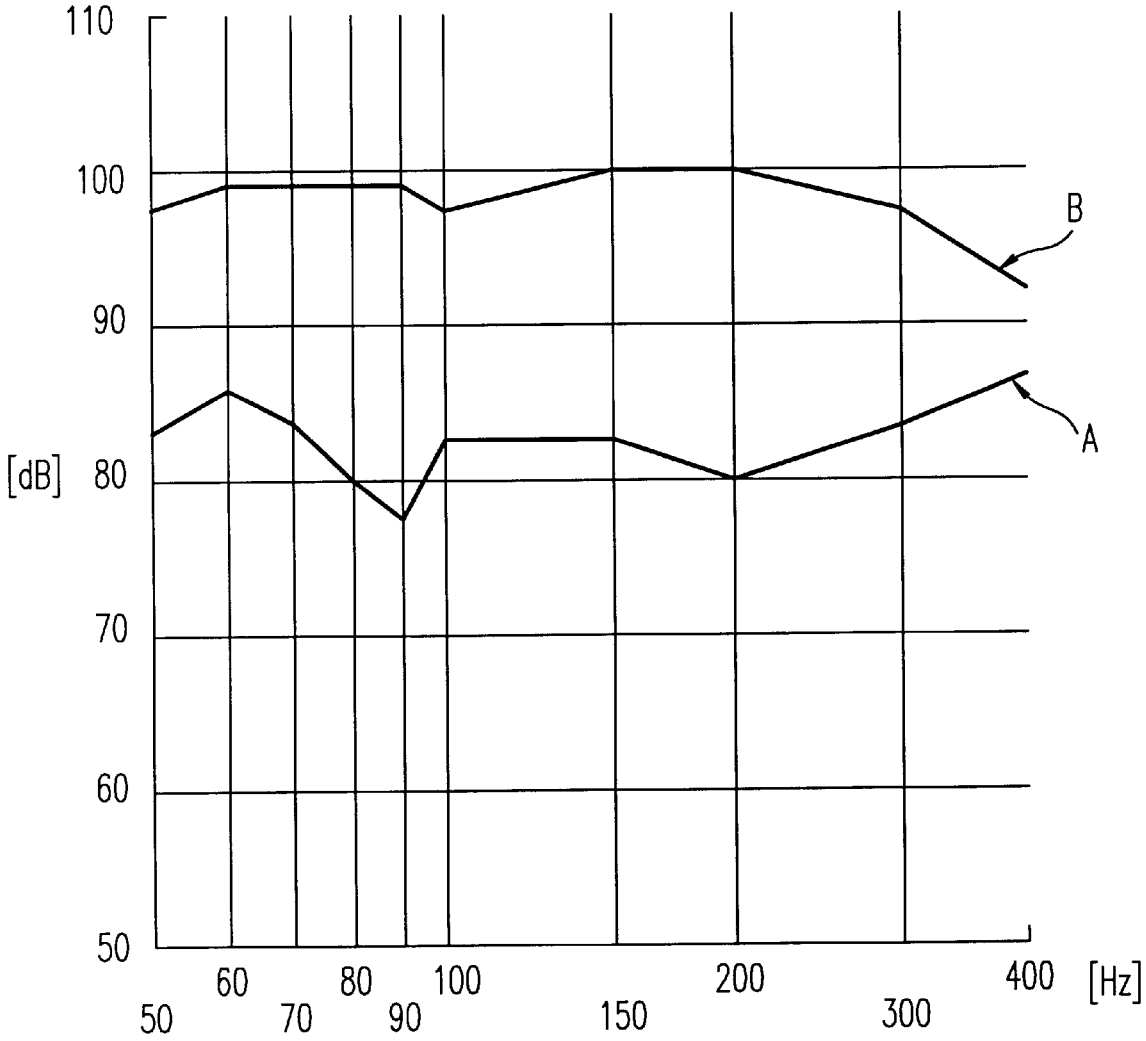
FIG. 27 shows the results of measuring a sound pressure level (pulse wave) of a test example.

The results thereof are shown in FIG. 25 (sine wave), FIG. 26 (sawtooth wave) and FIG. 27 (pulse wave).

Furthermore, in the figures, A represents a muffling panel with the unit, and B represents a muffling panel with no unit, respectively.

As shown in these figures, when the muffling panel of the present invention is used, the 100 dB sound generated by the oscillating apparatus is damped to a sound pressure level as low as 13 dB–25 dB in a low frequency band of around 50 Hz–200 Hz by the panel.

This signifies that, as sound energy, the transmitted sound energy was damped to 1/20th–1/300th compared with that of original sound.

Conversely, in the case of using the muffling panel with no unit, the 100 dB sound put out from the oscillating apparatus reached the measuring apparatus without being damped hardly at all.

In accordance with the above-mentioned results, it was confirmed that a 100 dB low sound between 50 Hz–200 Hz can be damped to 1/20th–1/300th by the muffling panel of the present invention.

Furthermore, similar tests which were conducted for other embodiments described below achieved practically the same results.

EXAMPLES

Next, the embodiments of the present invention are described in detail based on the figures, but the invention is not limited in any way by the following examples.

FIGS. 1–4 show an embodiment, wherein a transmitter, which is a preferable example of a vibration transmitting mechanism, is used as a constitution element thereof, and show an embodiment, wherein this transmitter comprises an oscillating link and secondary links.

Figure 1:
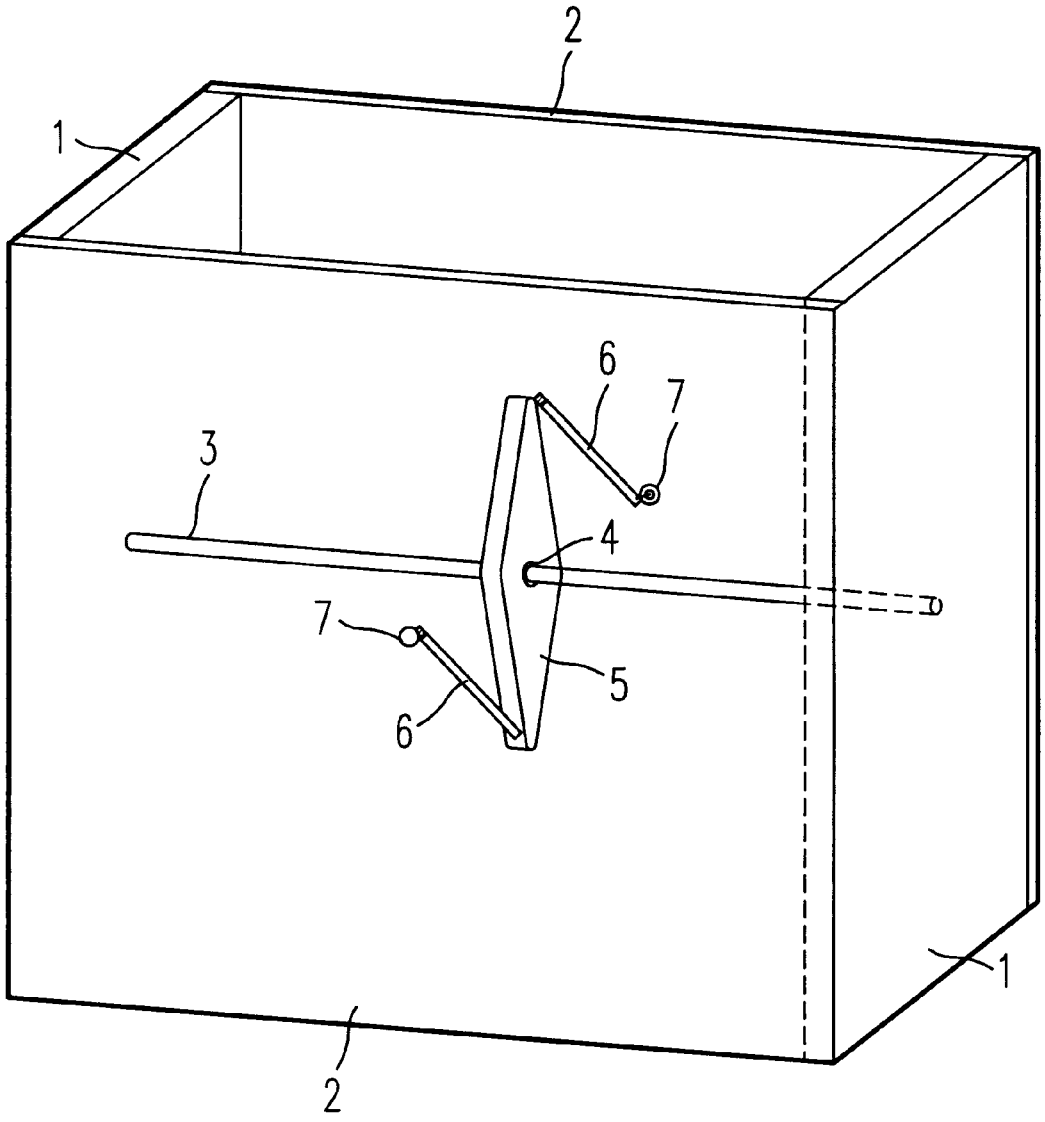
FIG. 1 is an oblique view showing an embodiment of a muffling panel of the present invention (oscillating link and secondary link structure).
Figure 2:
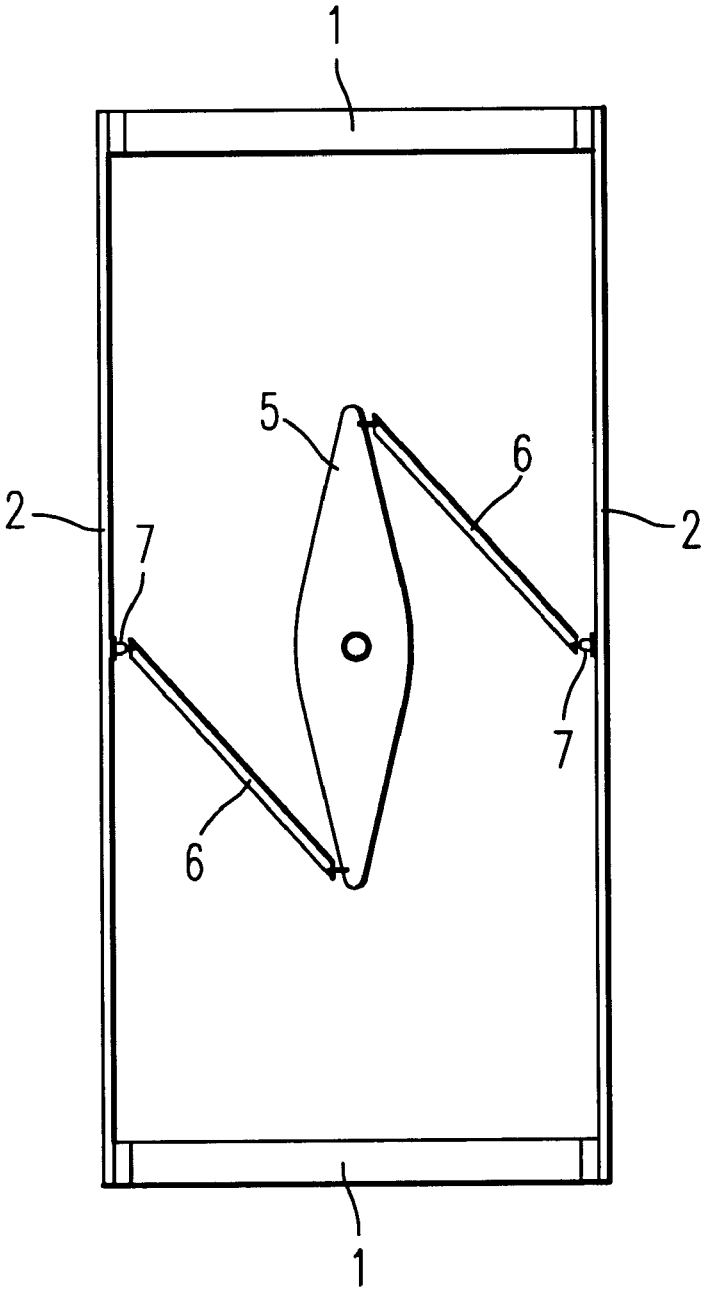
FIG. 2 is a cross-sectional view of FIG. 1.

Of these examples, in FIGS. 1 and 2 which are explained first, a panel is constituted by attaching two diaphragms 2 (plywood panels) in parallel to a frame body 1. A spindle 3 is provided between these diaphragms, an oscillating link 5 is supported in a freely rotating manner at a fixed point 4 in the middle of the spindle, and the oscillating link is designed so as to be able to rotate around the spindle.

A secondary link 6 is hinged to both ends of the oscillating link, respectively, and the ends of the secondary links are linked via pins 7 to corresponding diaphragms.

The operation of this muffling panel is explained below.

Figure 3A:
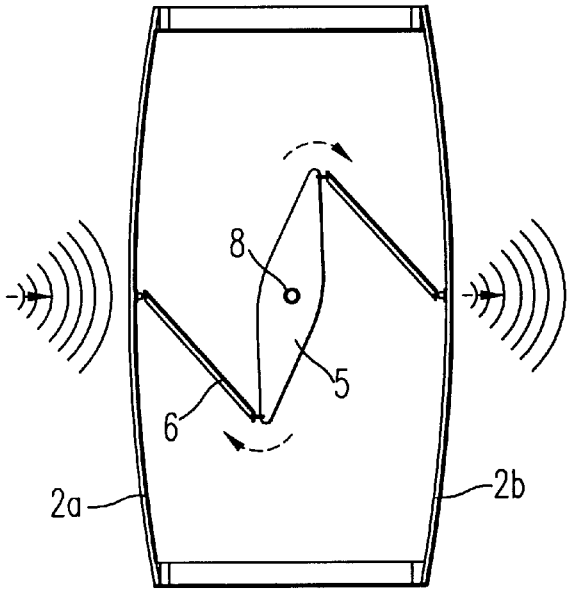
FIGS. 3(*a*) and 3(*b*) show the operation of the muffling panel of FIG. 1.
Figure 3B:
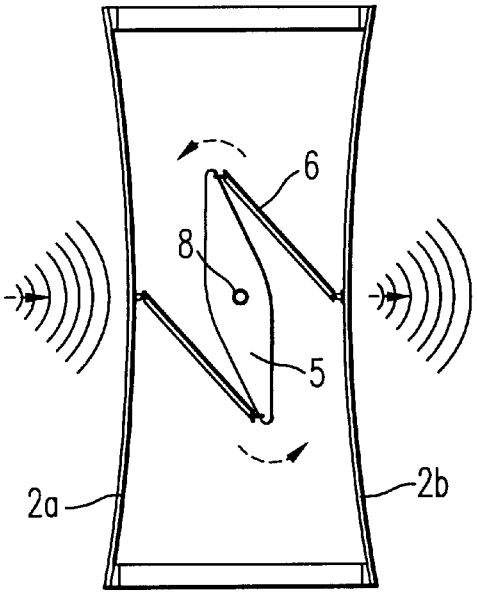

FIGS. 3(*a*) and 3(*b*) show a situation, wherein a relatively low sound, which has a wavelength that is about the same as the length (thickness) of the diaphragm 2, reaches this muffling panel.

When the sound strikes the left diaphragm 2*a*, this diaphragm 2*a* resonates. The vibration thereof is transmitted to the oscillating link 5, the oscillating link oscillates back and forth around the supporting point 8, causing the diaphragm 2*b* on the right side to vibrate.

That is, first, as shown in FIG. 3(*a*), when the left diaphragm 2*a* meets a thin portion of air, the left diaphragm 2*a* bends outward. Since the lower end of the oscillating link 5 is pulled in accordance therewith, the oscillating link 5 rotates clockwise around the support point 8, the upper end of the oscillation link is pushed, and the right diaphragm 2*b* bends outward.

Next, as shown in FIG. 3(*b*), when the left diaphragm 2*a* meets a dense portion of air, the left diaphragm 2*a* bends inward. Since the lower end of the oscillating link 5 is pushed in accordance therewith, the oscillating link 5 rotates counter-clockwise around the support point 8. As a result thereof, since the upper end of the oscillation link moves backward, the right diaphragm 2*b* also bends inward.

In this way, when the sound-source-side diaphragm 2*a* vibrates, the opposite-side diaphragm 2*b* vibrates with the movement of the oscillating link, moreover, it was learned that it vibrates in the opposite (reverse) phase. When the right diaphragm 2*b* vibrates, it generates a sound. The sound generated by this right diaphragm 2*b* is opposite in phase to the sound that comes passing through the left diaphragm 2*a*, and by the mutual negation thereof, the sound leaking through the opposite side panel can be held down to a sufficiently low level, and a high muffling and sound-absorbing effect can be achieved.

Figure 4:
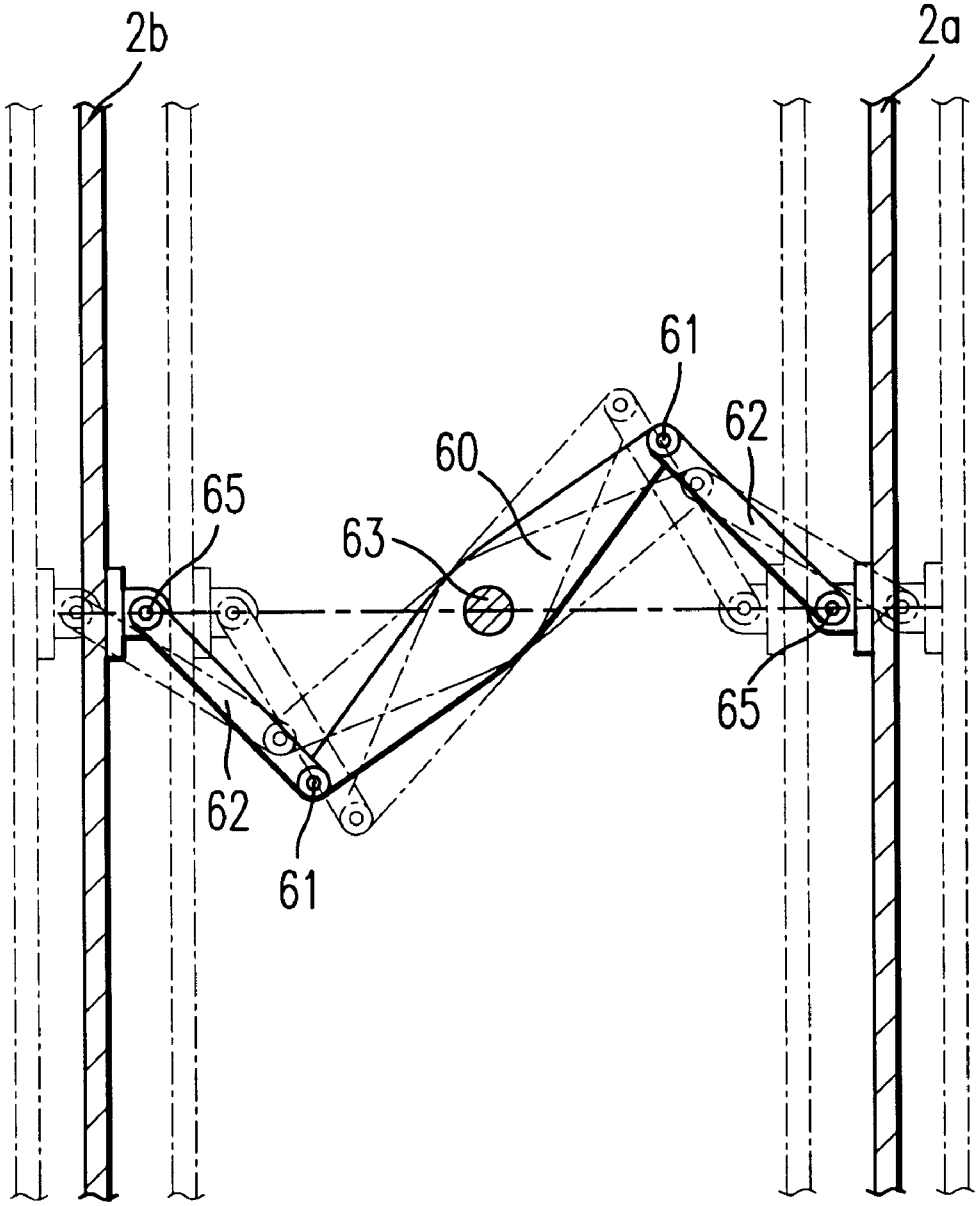
FIG. 4 is a cross-sectional view showing another embodiment of a muffling panel of the present invention.

FIG. 4 shows another embodiment of a transmitter.

A secondary link 62 is hinged via a pin 61 to both ends of a linear-shaped oscillating link 60. The center of the oscillating link 60 is supported on a support (not shown) by a pin 63 in a freely rotating manner. The tips of the secondary links 62 are linked by pins 65 to the inner surfaces of corresponding diaphragms 2*a*, 2*b*. The three pins 63, 65, 65 are located along the same straight line perpendicular to the diaphragms 2.

Because the transmitter is constituted in this way, when the right diaphragm 2*a*, for example, is subjected to a sound and bends inward, the upper end is pushed by the right secondary link, and the oscillating link 60 rotates counter-clockwise. In accordance therewith, the left secondary link is pulled, and the left diaphragm 2*b* also bends inward. Contrary thereto, when the right diaphragm 2*a* displaces outwardly, the upper end of the oscillating link is pulled via the right secondary link, the oscillating link rotates clockwise, and the left diaphragm 2*b* also displaces outwardly via the left secondary link. In this way, when the sound-source-side diaphragm vibrates, the opposite-side diaphragm vibrates at the opposite (reverse) phase.

In this example, the operating points (pins 65, 65) of the transmitter are located along the same straight line. Therefore, the left and right diaphragms vibrate in the same mode (the phase thereof differs), enhancing the muffling and sound-absorbing effect.

Figure 5:
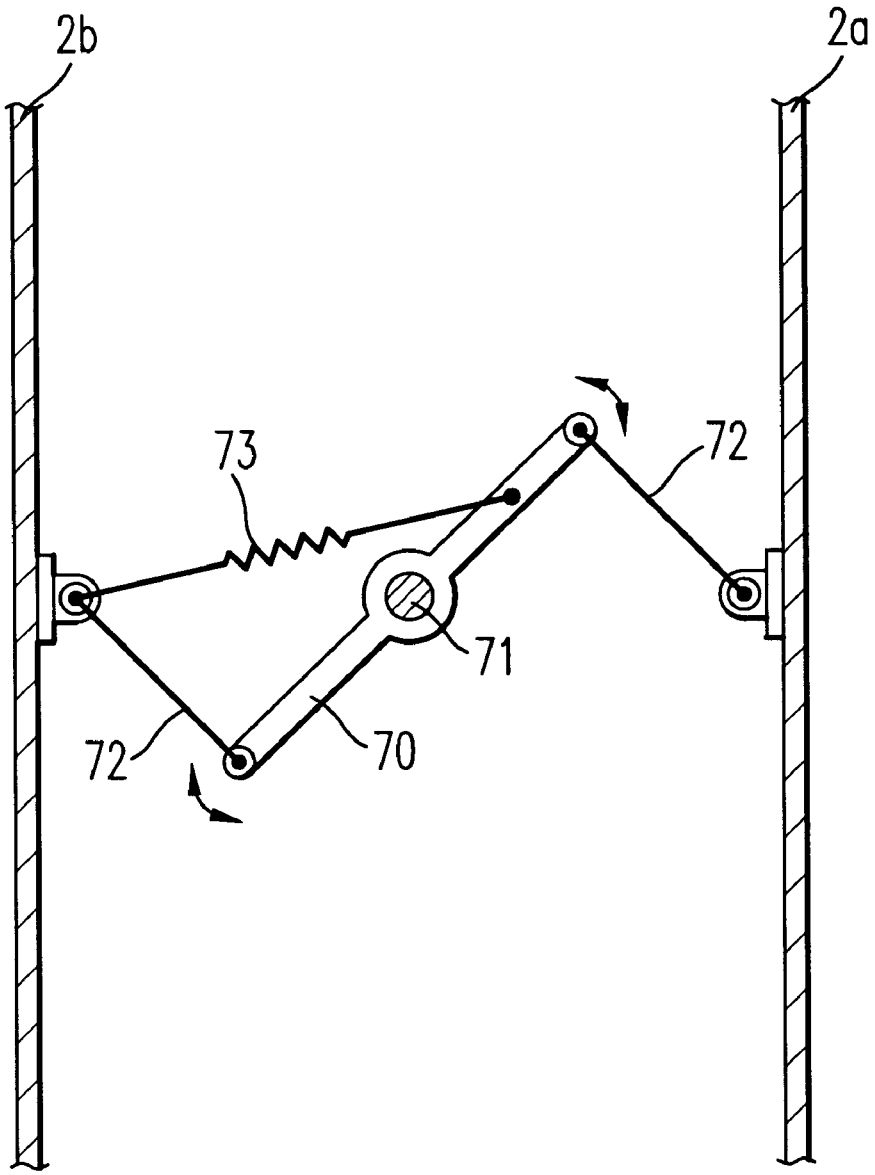
FIG. 5 is a cross-sectional view showing another embodiment of a muffling panel of the present invention (oscillating link and filament body structure).

FIG. 5 shows an embodiment of a different transmitter.

Similar to FIG. 4, an oscillation link 70 is supported in a freely rotating manner on a support (not shown) by a pin 71. Both ends of the oscillating link 70 are connected by filament bodies 72 to corresponding diaphragms. As a filament body, an artifact with little elongation, for example, a metal wire, is exemplified as being preferable. A bias spring (helical tension spring) 73 is attached between the oscillating link 70 and the diaphragm of one side. In accordance with the force of this spring, both filament bodies 72 are made tense, and the two diaphragms are caused to bend slightly inward within the limits of elasticity.

Because the transmitter is constituted in this way, when the right diaphragm 2*a*, for example, is subjected to a sound and bends inward, the oscillating link 70 rotates counter-clockwise, the left-side filament body is pulled, and the left diaphragm 2*b* also displaces inward. Contrary thereto, when the right diaphragm 2*a* moves outward, the oscillating link 70 rotates clockwise, the left-side filament body slackens, and the left diaphragm 2*b* displaces outwardly by its own elasticity. In this way, when one of the two diaphragms vibrates, the other vibrates at the opposite phase, and muffling and sound-absorbing effects similar to those described above are achieved.

FIGS. 6–11 show embodiments of a muffling panel with a grate (lattice) structure having a plurality of compartments.

Two opposing diaphragms 102 are formed in each compartment by applying a plastic film membrane body to both surfaces of the grate 101, a transmitter comprises an oscillating link 105 and secondary links 106, and is linked to a diaphragm 102*a* on one side of one compartment, and a diaphragm 102*b* on the opposite side of another compartment. The oscillating link is S-shaped, passes through a hole 109 formed in the grate, and is supported midway therethrough in a freely rotating manner by a spindle 103. The tip of each secondary link 106 is linked via a pin 107 to a corresponding diaphragm.

Figure 6:
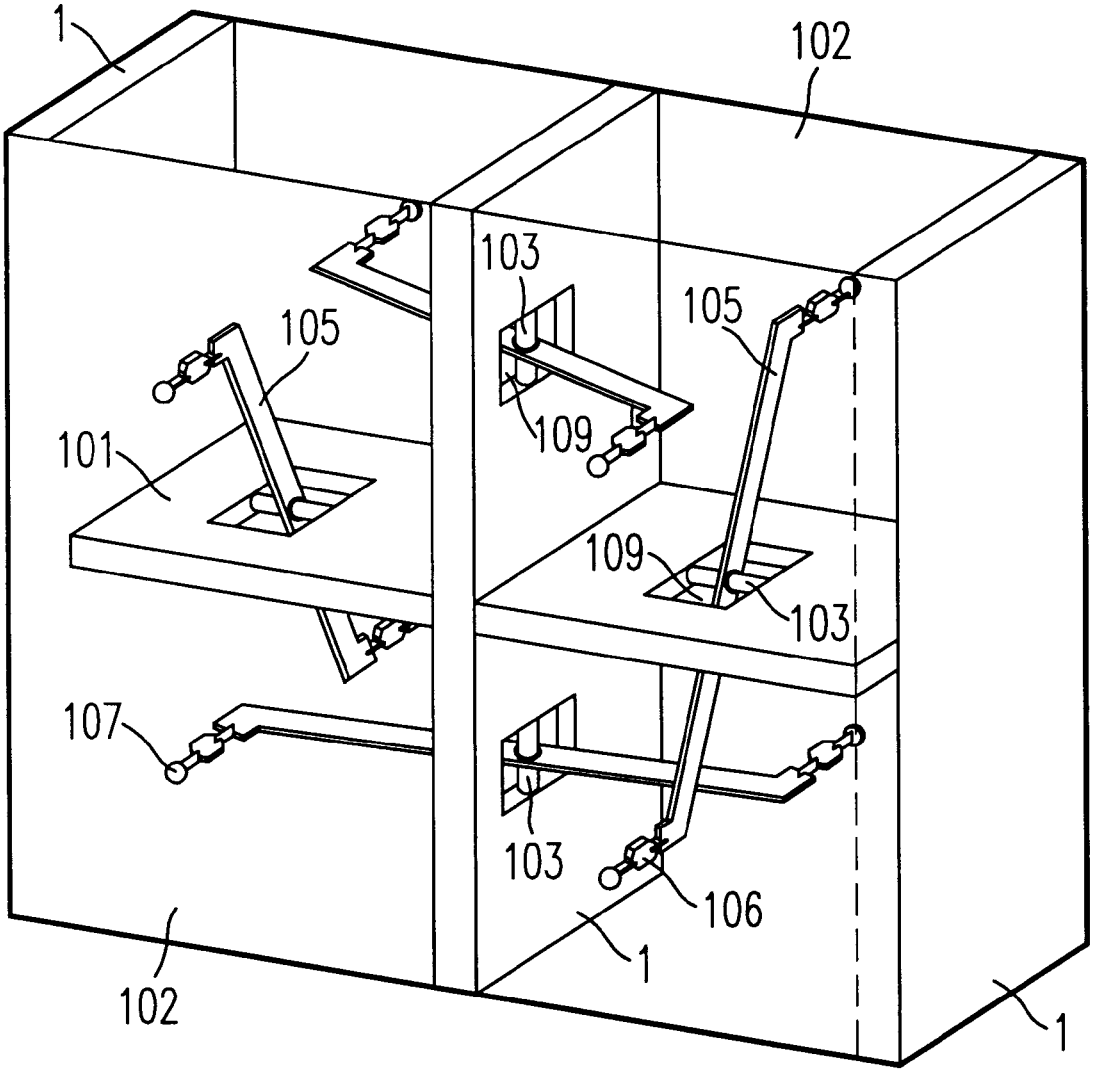
FIG. 6 is an oblique view showing another embodiment of a muffling panel of the present invention (grate structure).
Figure 7:
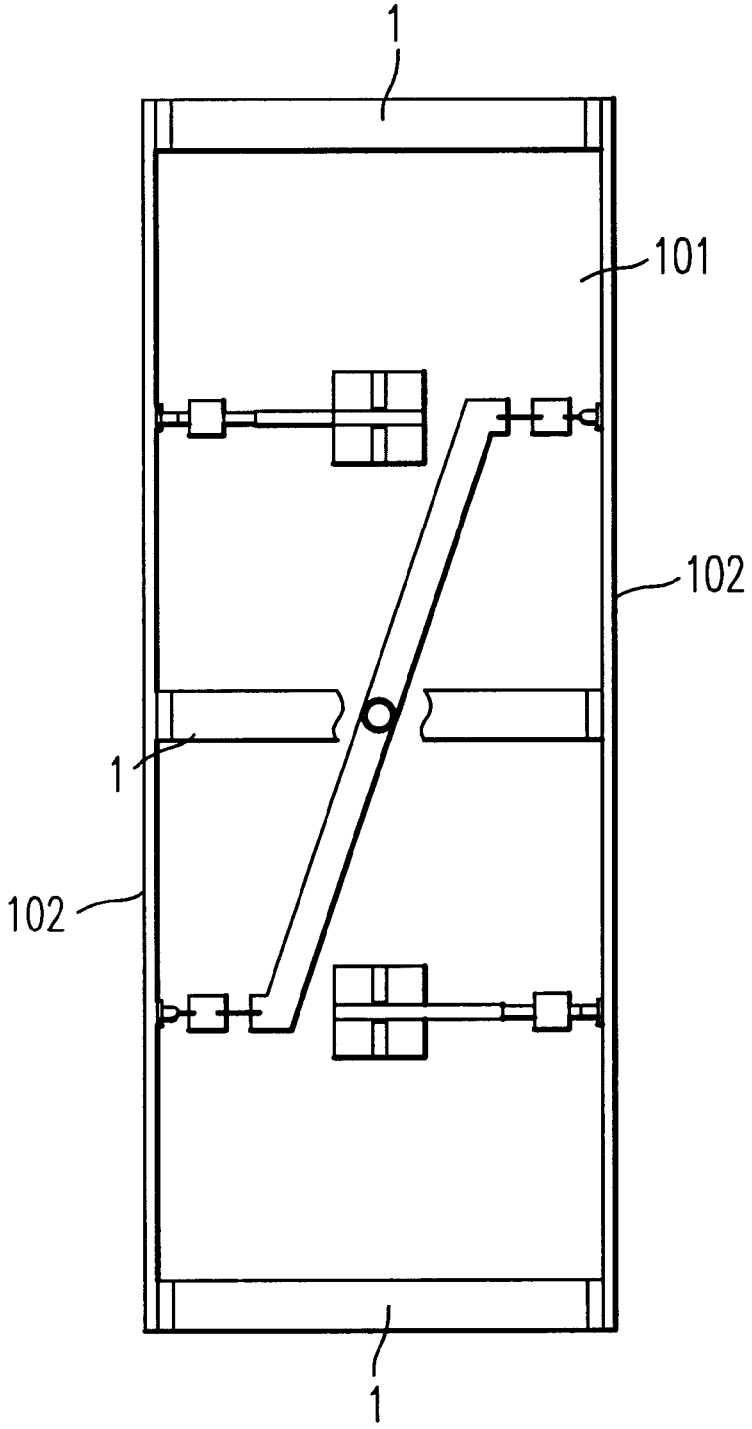
FIG. 7 is a cross-sectional view of FIG. 6.
Figure 8A:
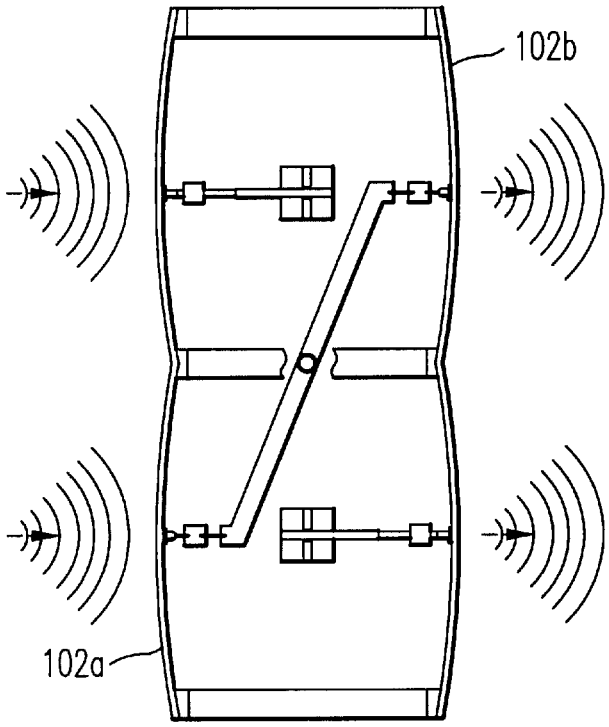
FIGS. 8(*a*) and 8(*b*) show the operation of the muffling panel of FIG. 6.
Figure 8B:
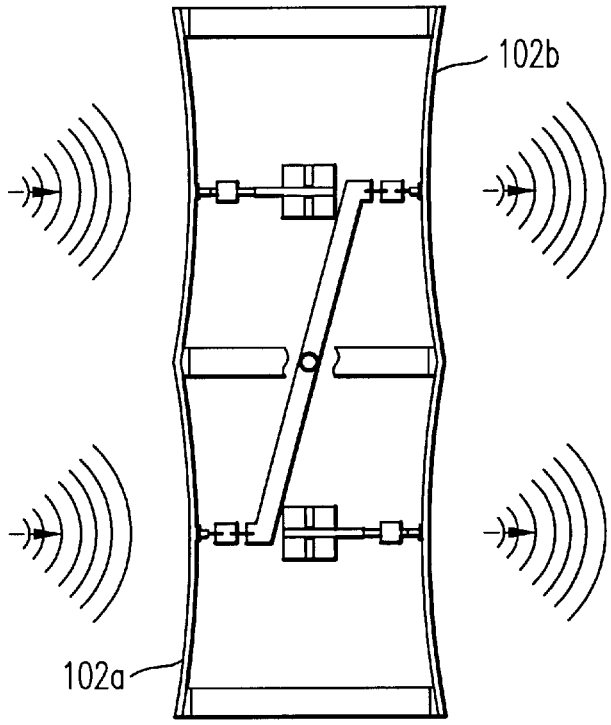
Figure 9:
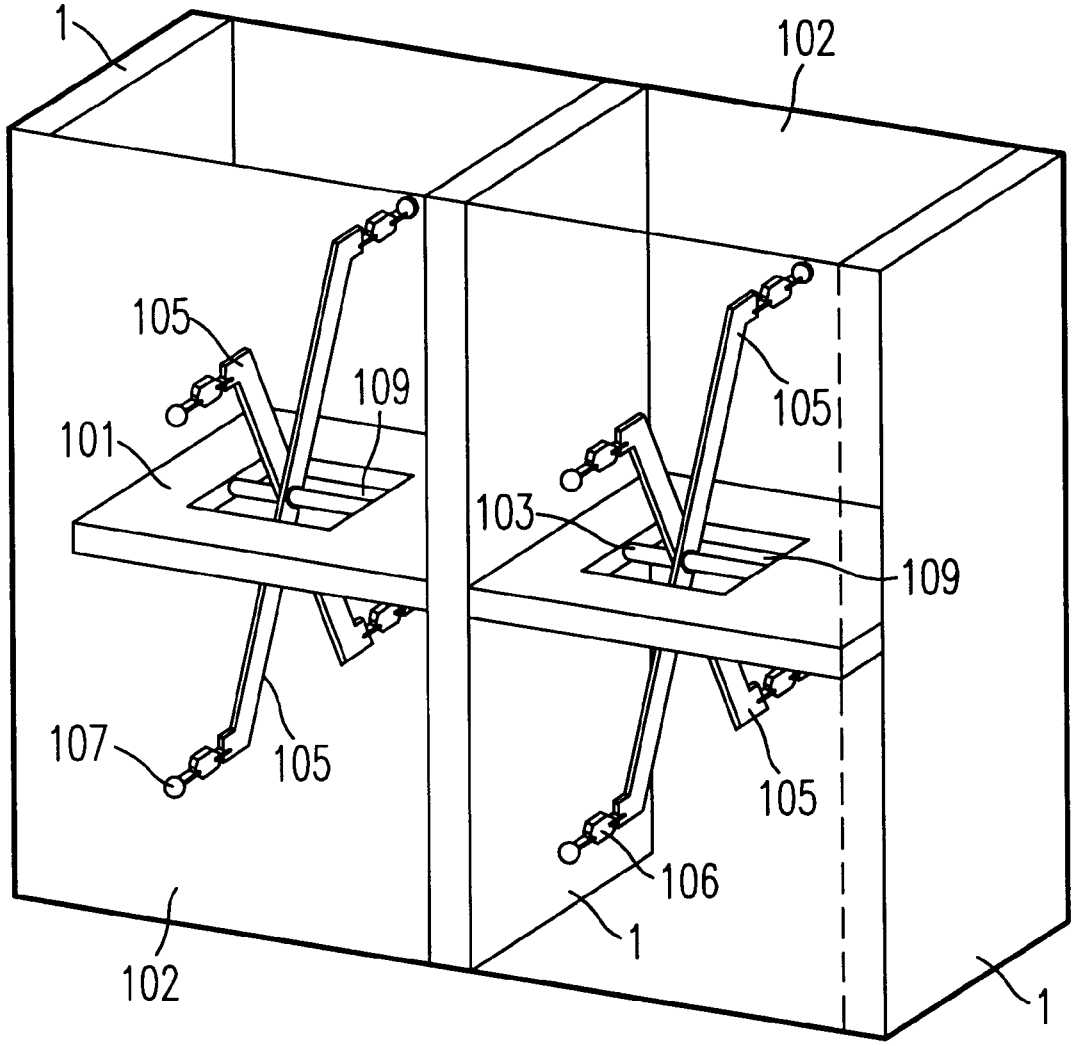
FIG. 9 is a cross-sectional view showing another embodiment of a muffling panel of the present invention (grate structure).
Figure 10:
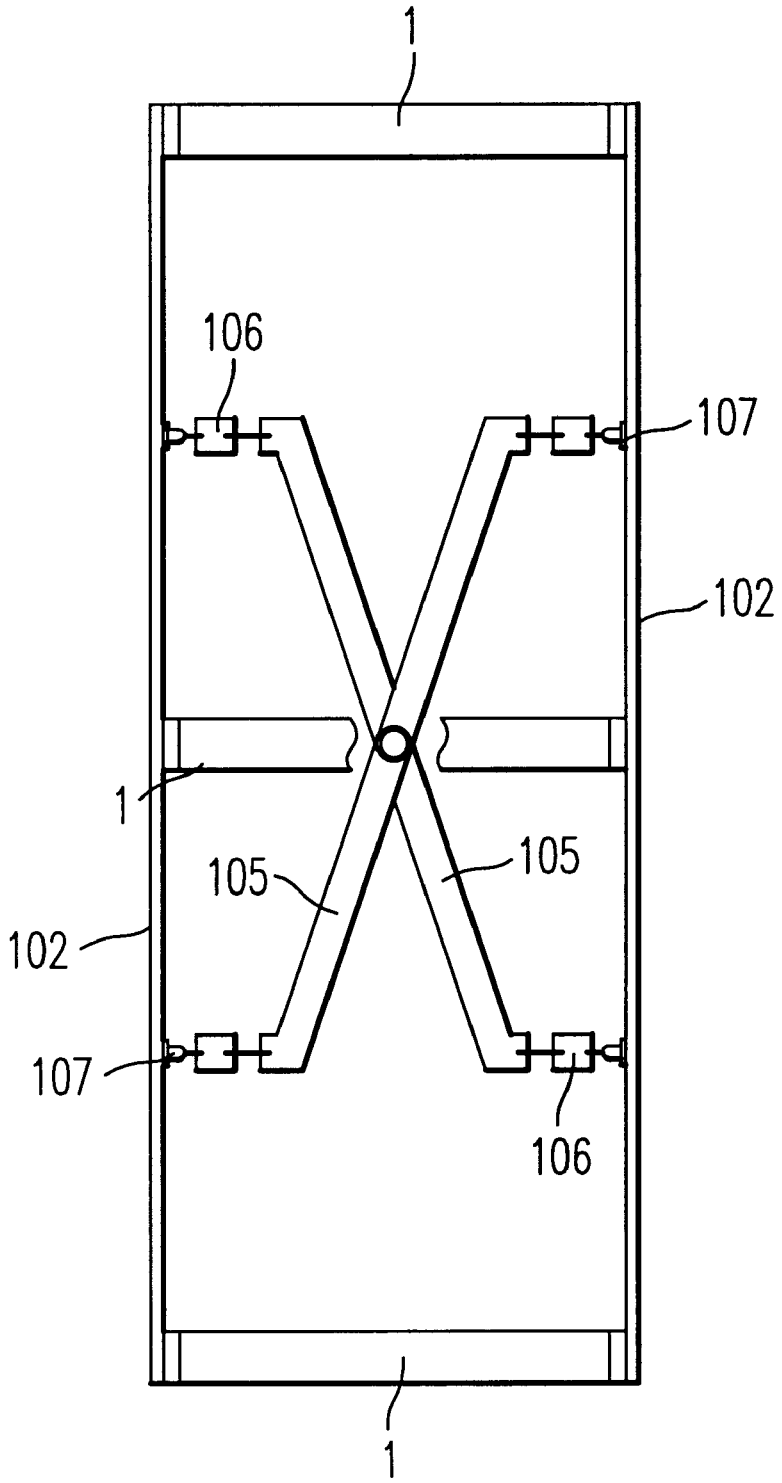
FIG. 10 is a cross-sectional view of FIG. 9.
Figure 11A:
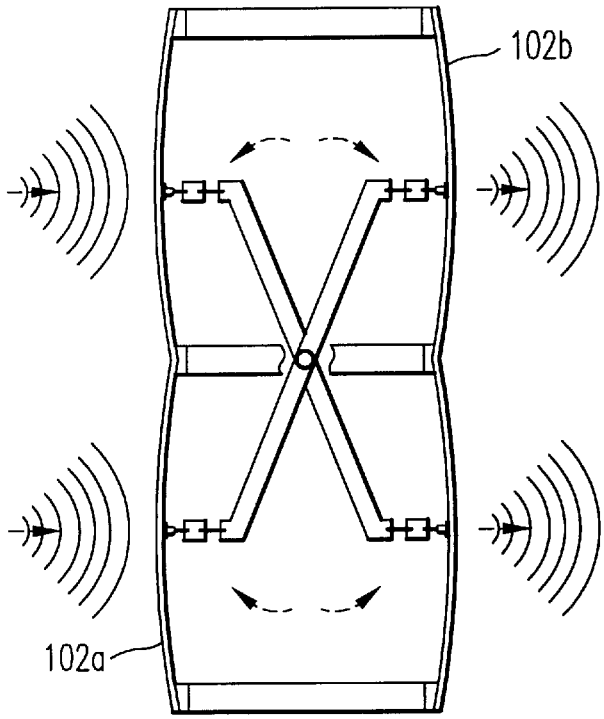
FIGS. 11(*a*) and 11(*b*) show the operation of the muffling panel of FIG. 9.
Figure 11B:
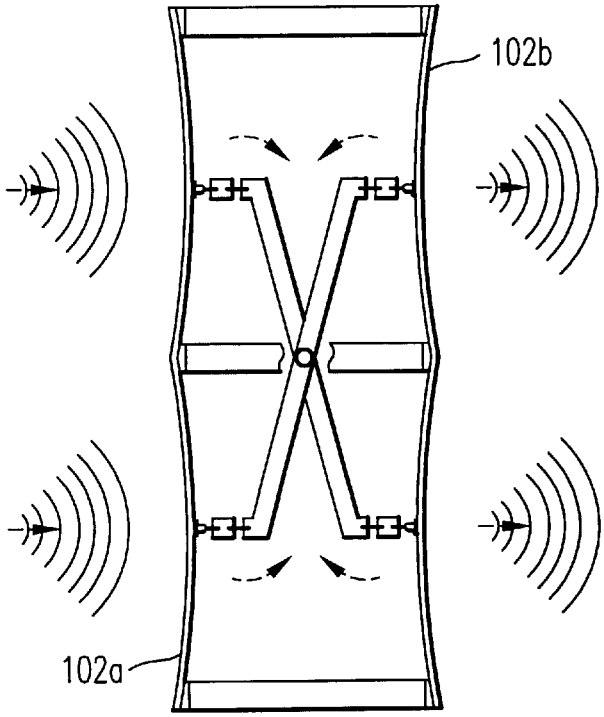

As preferable embodiments of this muffling panel, one in which one transmitter is supported by a spindle (FIGS. 6–8(*a,b*)), and one in which two transmitters are supported on a spindle (FIGS. 9–11(*a,b*)) are given. These muffling panels transmit the vibrations of a diaphragm in each compartment to the diaphragm on the opposite side of an adjacent compartment at the opposite (reverse) phase (FIGS. 8(*a,b*) and 11(*a,b*)), achieving a high muffling and sound-absorbing effect, and are also advantageous in that they facilitate the unitization of the muffling mechanism utilized in the present invention.

Since the operation of these muffling panels (FIGS. 8(*a,b*) and 11(*a,b*)) is the same as that described in FIGS. 3(*a,b*) above, an explanation has been omitted.

Figure 12:
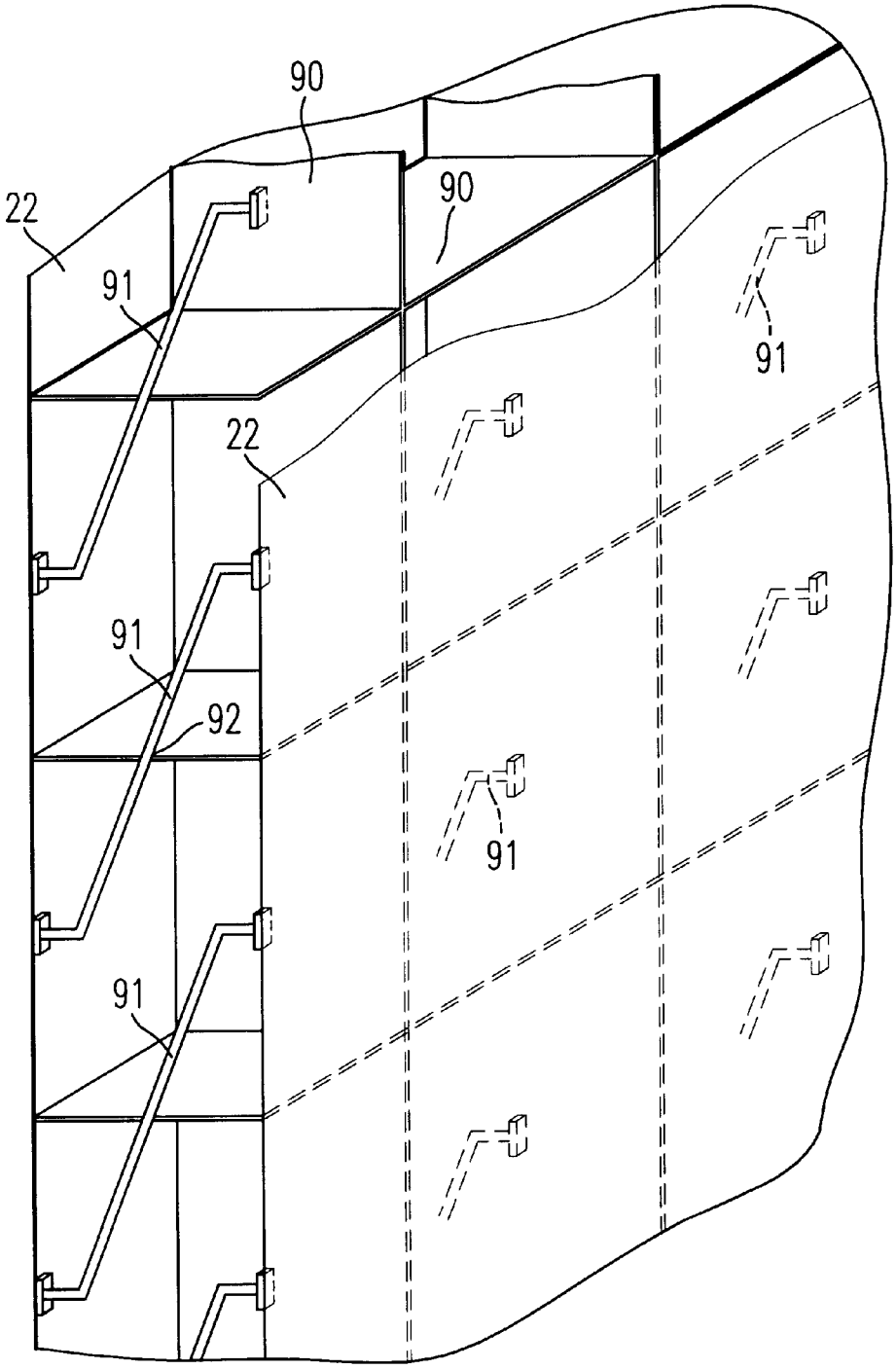
FIG. 12 is an oblique view showing another embodiment of a muffling panel of the present invention (grate structure).

FIG. 12 shows an embodiment of a muffling panel with a different lattice construction.

This constitutes a vibration transmitting mechanism which is comprising a transmitter alone. The lattice 90 comprises horizontal and vertical members, to which plastic film is applied to form a diaphragm 22. The transmitter 91 is S-shaped, passes through a hole 92 formed in the lattice 90, and is supported in the middle thereof by the lattice 90 in a freely rotating manner.

The tip of each transmitter 91 is linked directly to a corresponding diaphragm 22. This muffling panel also transmits the vibrations of a diaphragm in each compartment to the diaphragm on the opposite side of an adjacent compartment at the opposite (reverse) phase, thus achieving a high muffling and sound-absorbing effect.

FIGS. 13–16(*a,b*) show another different examples of transmitters.

Figure 14A:
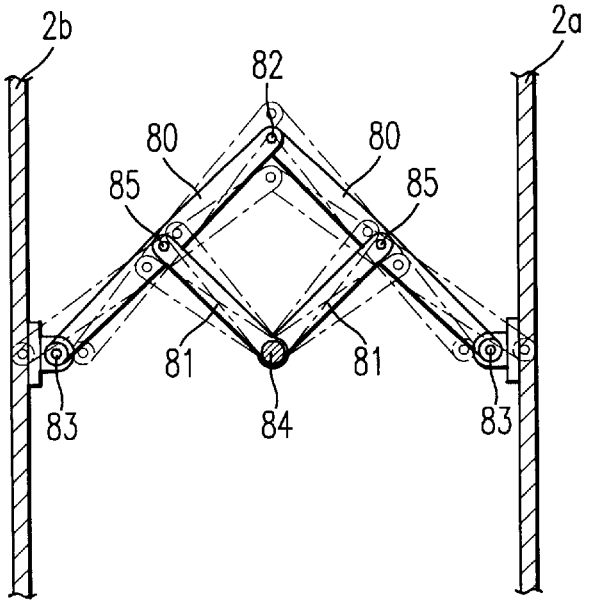
FIGS. 14(*a*) and 14(*b*) show the detailed structure of a parallel link.
Figure 14B:
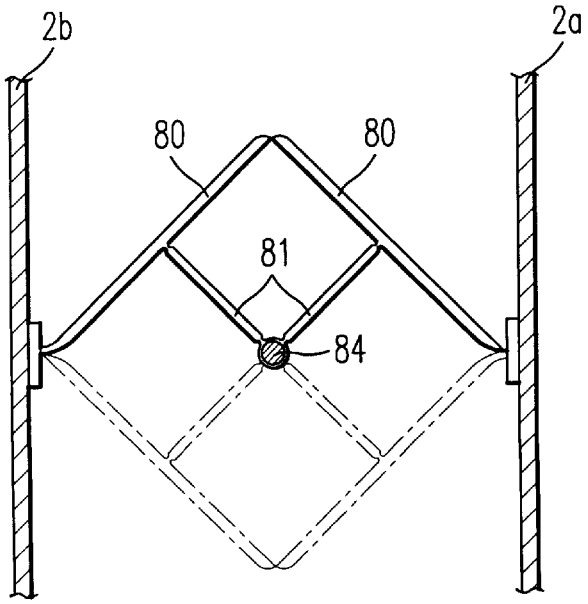

In FIG. 14(*a*), a transmitter comprises two each main links 80 and secondary links 81, and these constitute parallel links. The two main links 80 are hinged to one another via a pin 82, and the ends thereof are linked to corresponding diaphragms via pins 83. 84 is a spindle provided between two diaphragms, and two secondary links 81 are each supported thereby in a freely rotating manner.

The tips of the secondary links 81 are hinged at midpoints of corresponding main links 80 via pins 85.

The operation of this transmitter is described below.

In this embodiment, when the right diaphragm 2*a*, for example, is subjected to a sound, and moves inward, the angle of the two main links 80 becomes smaller, as indicated by the chain line in the figure, and the left diaphragm 2*b* also moves inward. Contrary thereto, when the right diaphragm 2*a* moves outward, the angle of the two main links increases, and the left diaphragm 2*a* also displaces outwardly. Thus, diaphragms on both sides vibrate at the opposite (reverse) phase, thus exhibiting muffling action.

FIG. 14(*b*) shows an example in which the same muffling panel as that described above is integrally formed using plastic. In this embodiment, the thickness of the link-to-link connecting portions is thinly formed, and since the links bend easily at these portions, the functioning thereof is the same as when linked via pins.

Figure 13:
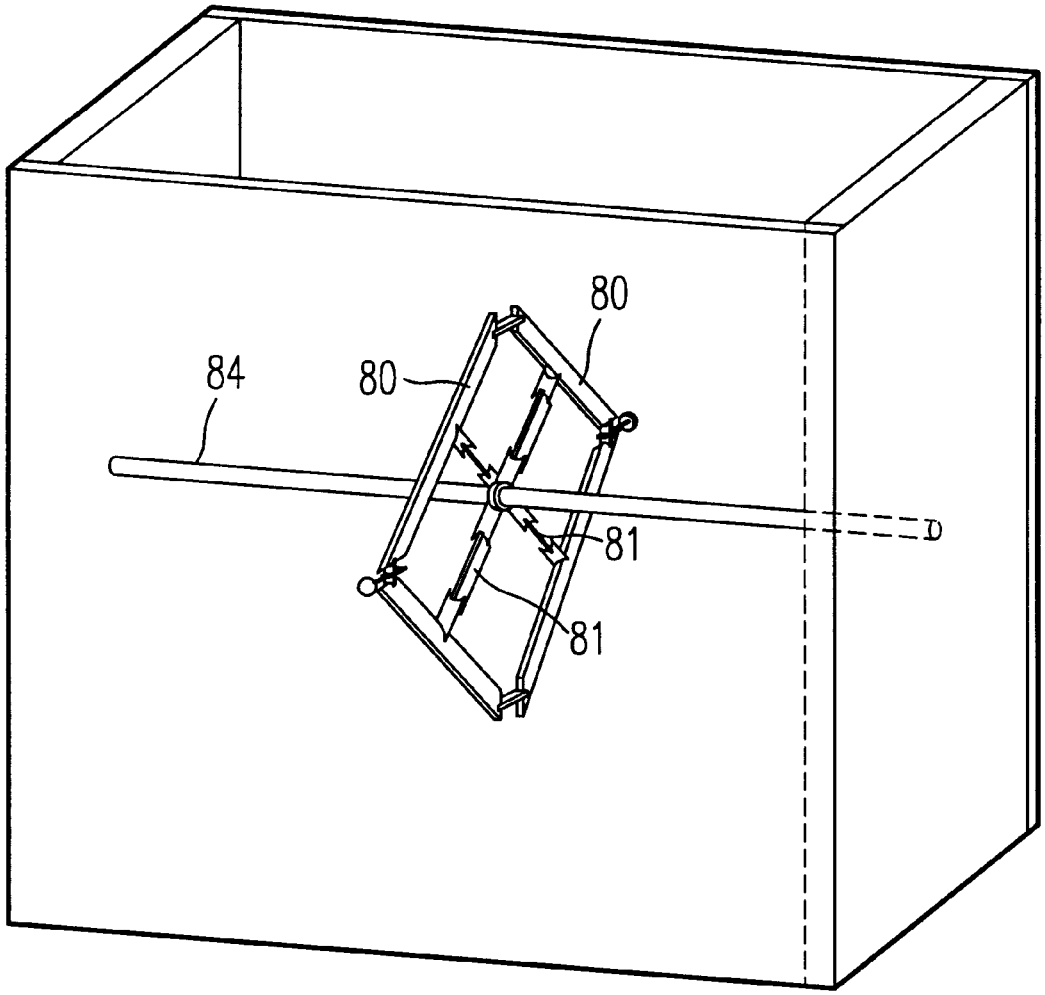
FIG. 13 is an oblique view showing another embodiment of a muffling panel of the present invention (parallel link structure).
Figure 15:
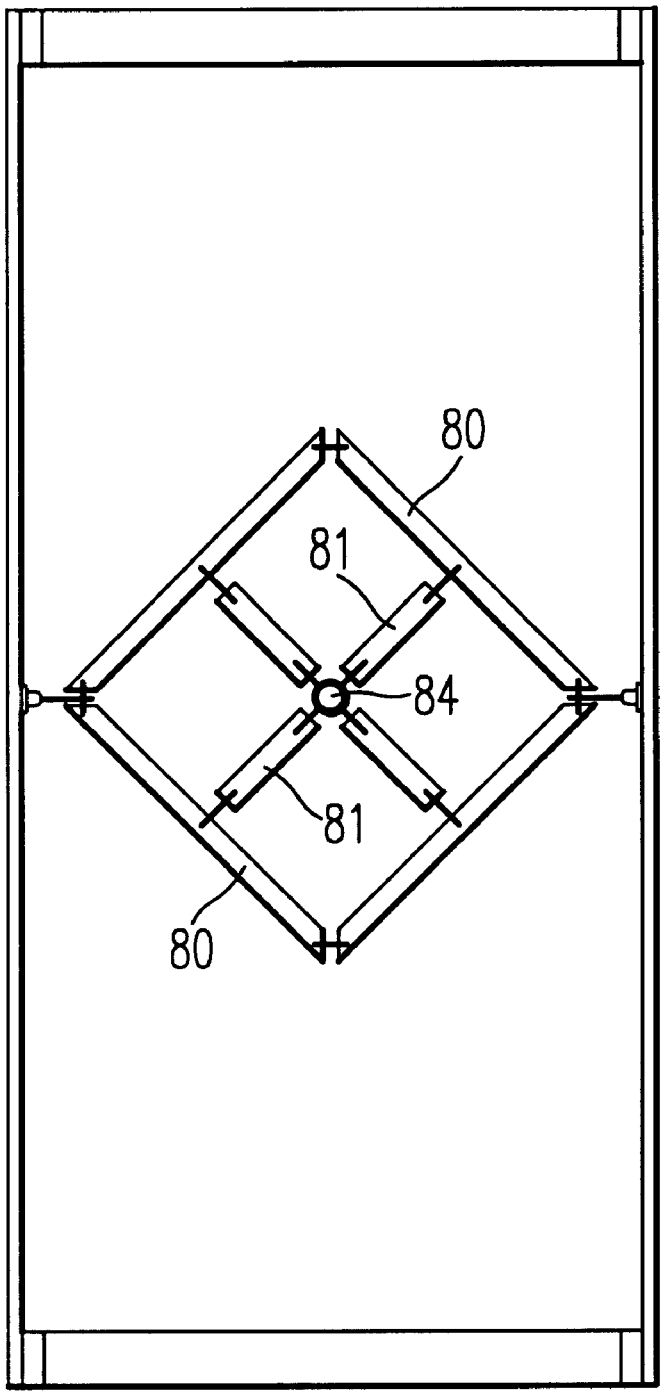
FIG. 15 is a cross-sectional view of FIG. 12.
Figure 16A:
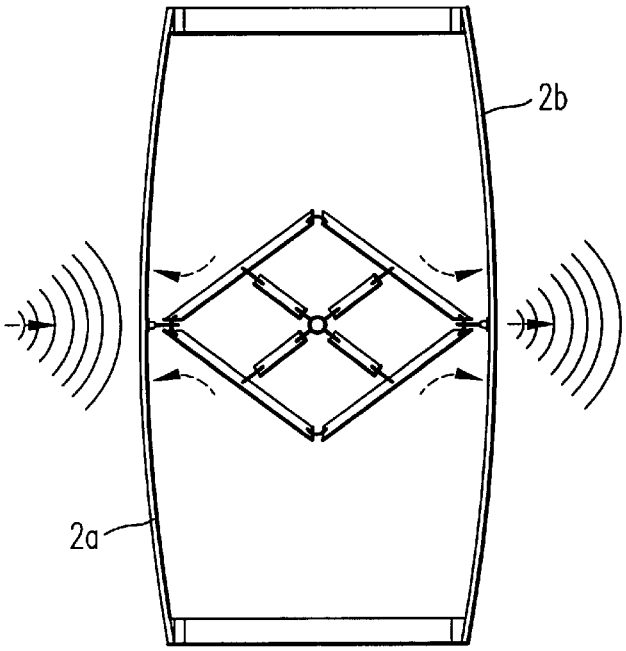
FIGS. 16(*a*) and 16(*b*) show the operation of the muffling panel of FIG. 12.
Figure 16B:
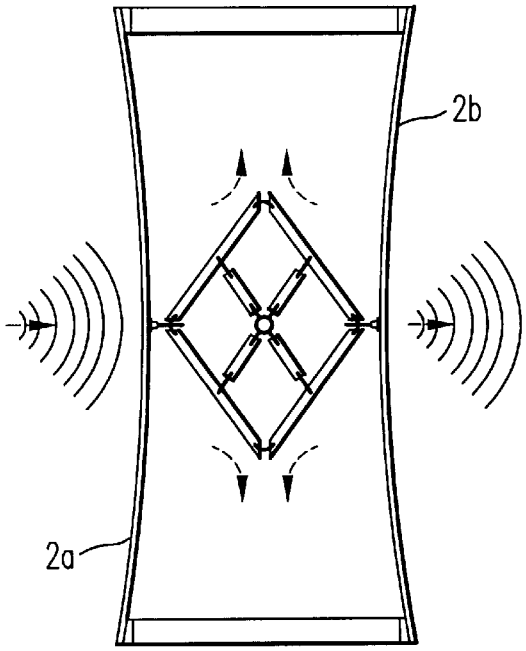

Furthermore, as indicated by the chain lines in the figure, two same-shaped links can be combined, making it possible to form four parallel links overall. The embodiment thereof is shown in FIGS. 13, 15 and 16(*a,b*).

Because the constitution of these muffling panels and the operation thereof are the same as those described above, an explanation has been omitted.

Figure 17:
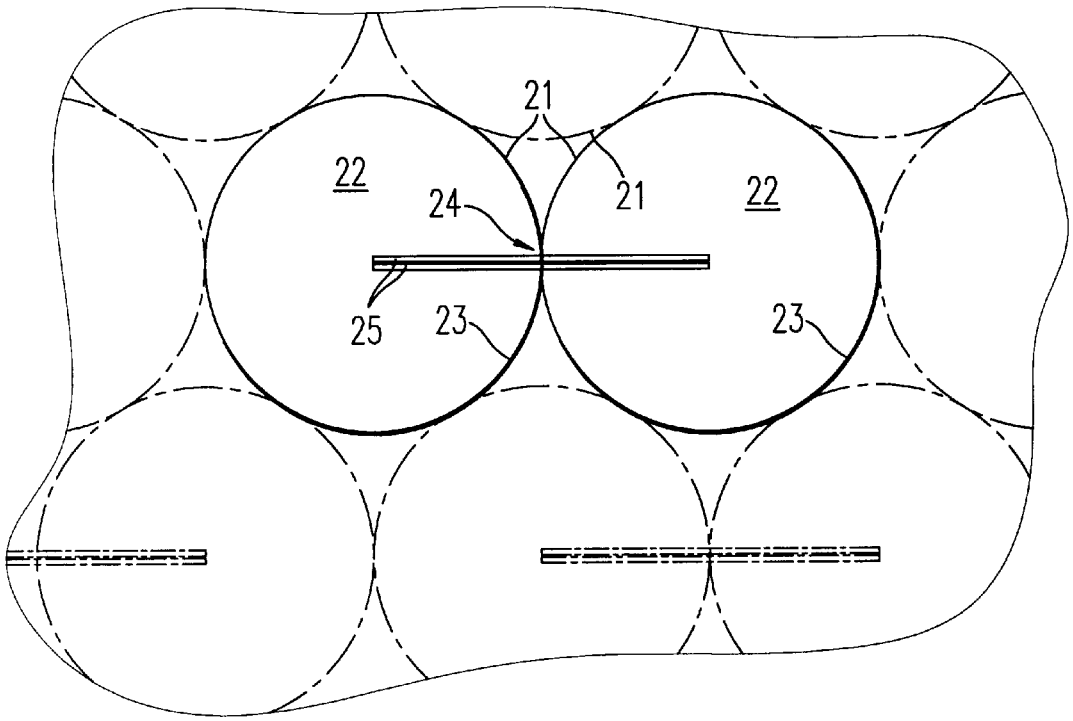
FIG. 17 is a plan view showing another embodiment of a muffling panel of the present invention (lattice structure).
Figure 18:
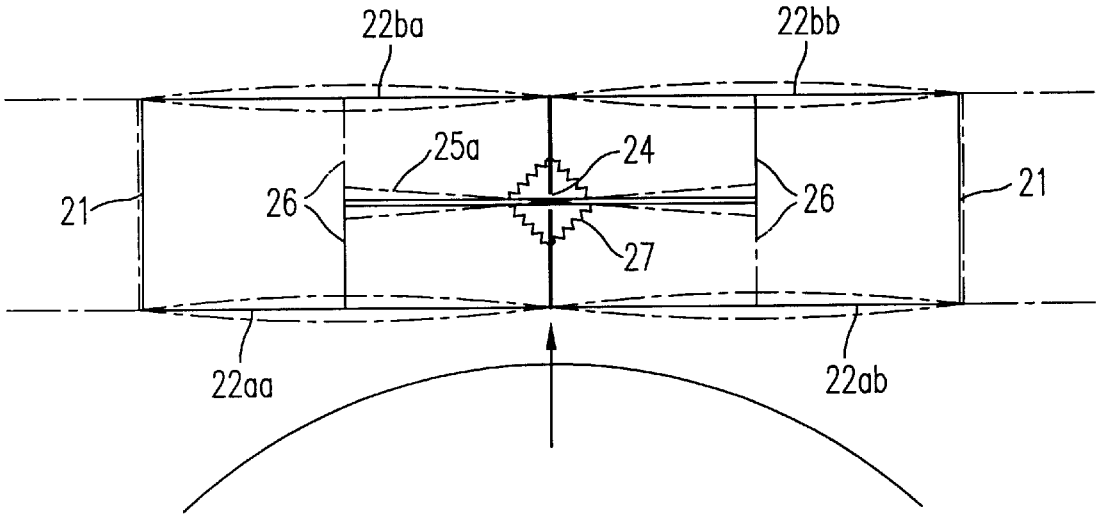
FIG. 18 is a cross-sectional view of the muffling panel of FIG. 17.
Figure 19:
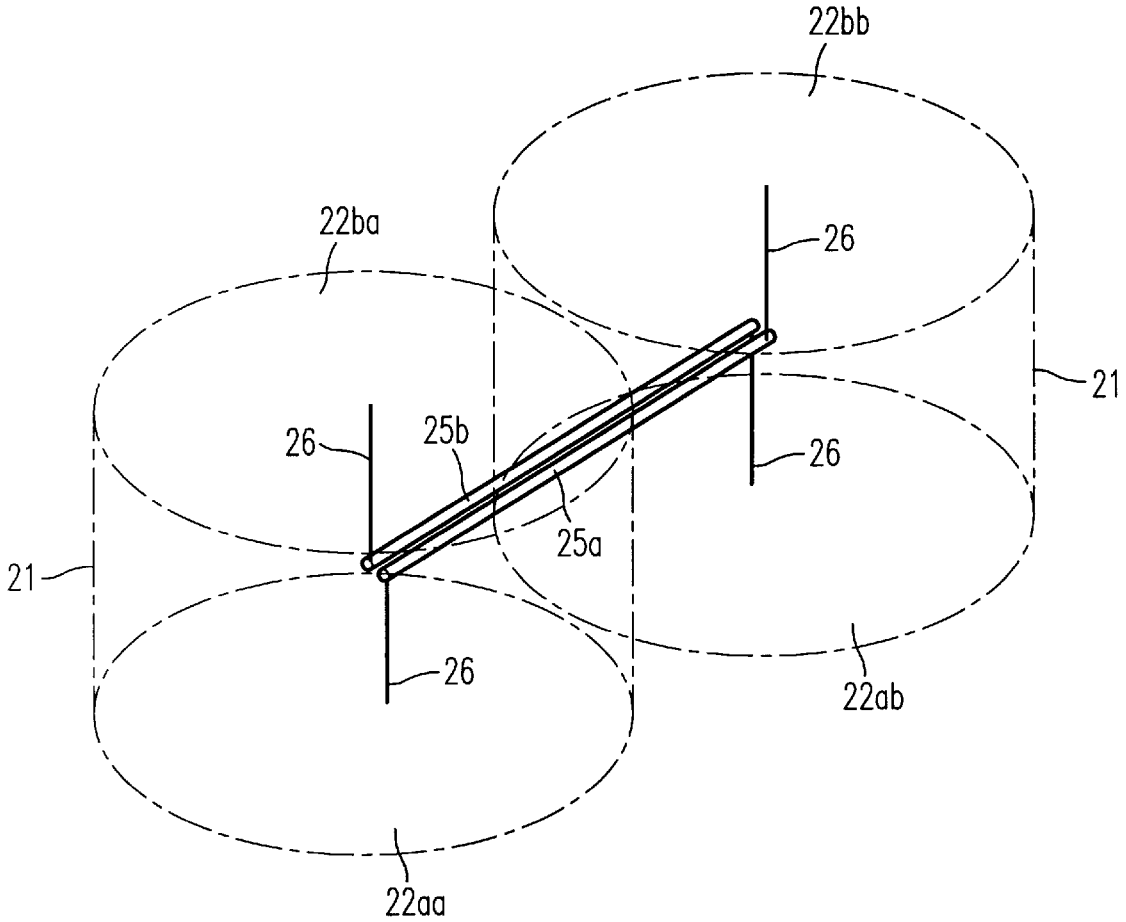
FIG. 19 is an oblique view of the muffling panel of FIG. 17.

FIGS. 17–19 show an embodiment of a muffling panel with a different lattice structure.

As shown in FIGS. 17 and 18, the lattice 21 is a plurality of interconnected cylindrical bodies. Two opposing diaphragms 22 are formed in each compartment by applying a plastic film to both sides of the lattice 21. A small air-bleeder hole 23 is provided in each cylindrical body 21.

In this embodiment, two cylindrical-shaped compartments form one pair, a hole 24 is formed in the partition therebetween, two oscillating links 25 pass through this hole, and each oscillating link is supported in a freely rotating manner by this partition. The ends of each oscillating link 25 are connected to two diaphragms 22 by filament bodies 26 (FIG. 18, FIG. 19). And then, each oscillating link is biased by a bias spring 27 to rotate so as to put tension on a filament body 26.

The operation of the muffling panel is explained below.

In this embodiment, when sound-source-side (side indicated by the arrow in FIG. 18) diaphragms 22*aa*, 22*ab* vibrate upon being subjected to a sound, the vibration thereof is transmitted to oscillating link 25*a*, 25*b* via the filament body 26. The vibration of the oscillating link is transmitted to diaphragms 22*ba*, 22*bb* on the opposite side of the sound source via the opposite-side filament body 26.

In this example, the oscillating link 25 and filament body 26 work in concert, performing the same function as the oscillating link 6 in FIG. 1, and the vibration of diaphragm 22*aa* is transmitted to diaphragm 22*bb*, and the vibration of diaphragm 22*ab* is transmitted to diaphragm 22*ba*, respectively, at the opposite (reverse) phase. Therefore, a sound that is transmitted through a sound-source-side diaphragm 22*a*, and an opposite-phase sound generated by a diaphragm 22*b* on the opposite side negate one another, thus achieving a muffling and sound-absorbing effect.

Figure 20:
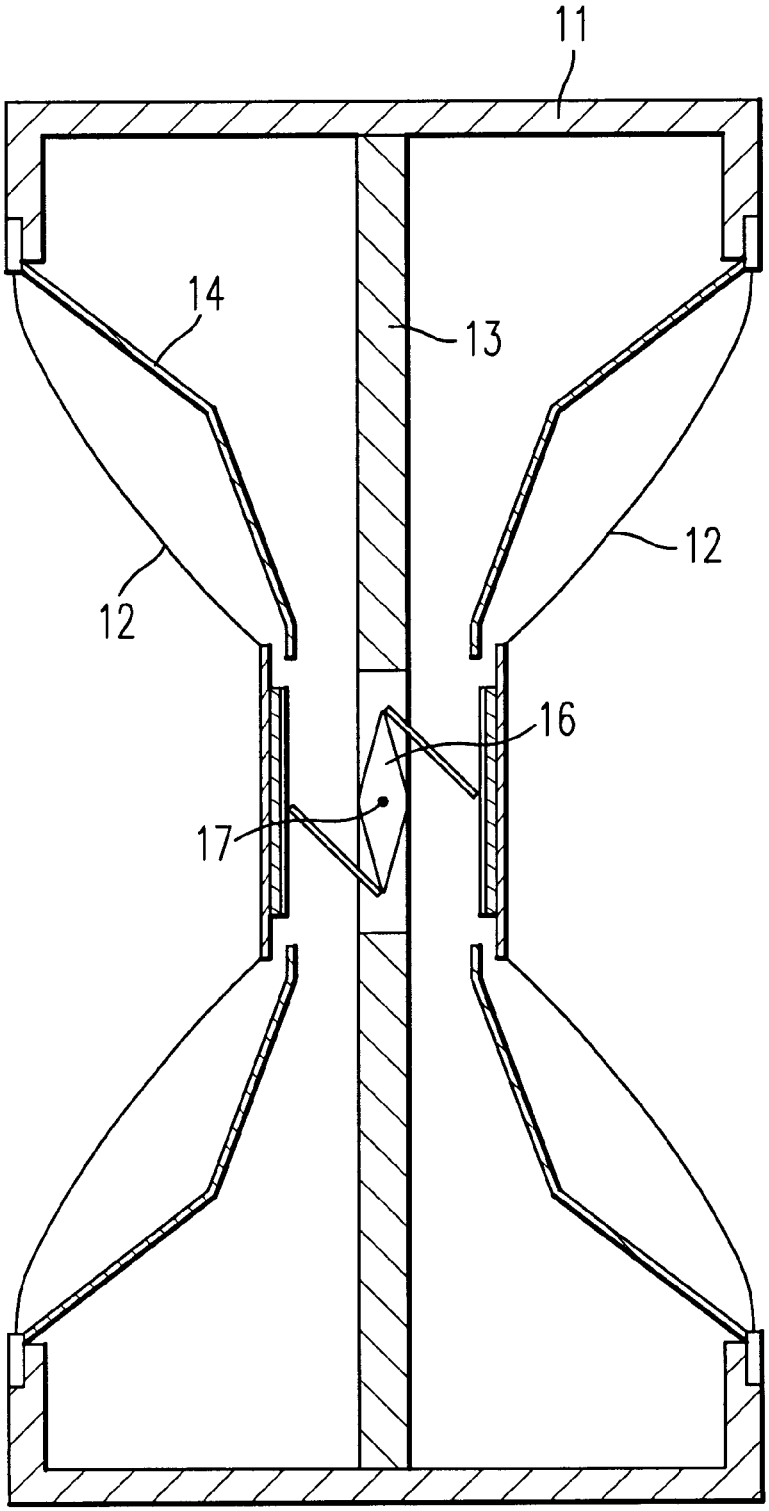
FIG. 20 is a cross-sectional view showing another embodiment of a muffling panel of the present invention (trumpet-shaped structure).

FIG. 20 shows an embodiment which is constituted in speaker box style.

A trumpet-shaped diaphragm (cone paper) 12 supported by a dome-type frame 14 is mounted on both sides of a box body 11, respectively. A partitioning panel 13 is provided in the middle of the box body, and an oscillating link 16, and two secondary links, which are the same transmitter as that shown in FIG. 1, are attached to this partitioning panel via pins 17 in a freely rotating manner. Both ends of the oscillating link are affixed to diaphragms 12 via pins.

The operation of this muffling panel is the same as that described above, and when the sound-source-side diaphragm 12 vibrates, the opposite-side diaphragm 12 vibrates at the opposite phase via the oscillating link 6, and the sound that passes through the sound-source-side diaphragm, and the sound generated by the opposite-side diaphragm negate one another, thus producing a muffling effect.

In this embodiment, a box body 11 and a partitioning panel 13 form a dedicated box for each diaphragm, thereby having the effect of stabilizing the vibration of a trumpet-shaped diaphragm 12, and more particularly, effect of effectively reproducing an opposite-phase, low-sound-range sound.

Figure 21:
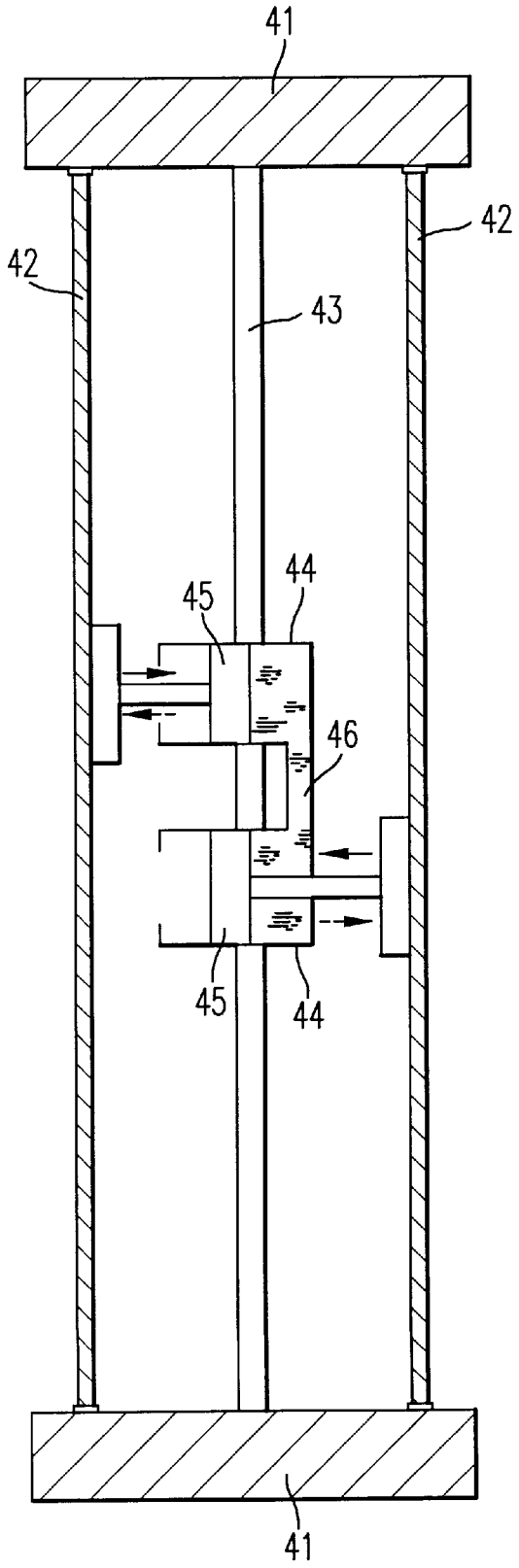
FIG. 21 is a cross-sectional view showing another embodiment of a vibration transmitting mechanism.

FIG. 21 shows an embodiment of a vibration transmitting mechanism, which utilizes a piston cylinder.

A space is provided between two diaphragms 42, and they are mounted to a frame body 41. A support 43 is set up in the middle of the frame body, and two cylinders 44, respectively, are mounted laterally to this support.

The two cylinders are connected by a pipe 46, and inside are filled with a working fluid. A piston 45 is fitted into each cylinder, and each piston is linked to a corresponding diaphragm. The top and bottom cylinders are mounted left and right in the opposite direction. When the sound-source-side diaphragm vibrates, this vibration is transmitted to the other-side diaphragm via the corresponding piston, working fluid, and other-side piston. Since the top and bottom cylinders face in opposite directions, the other-side diaphragm vibrates at the opposite phase of the sound-source-side diaphragm, and similar to the above-described embodiment, produces a muffling effect.

Figure 22:
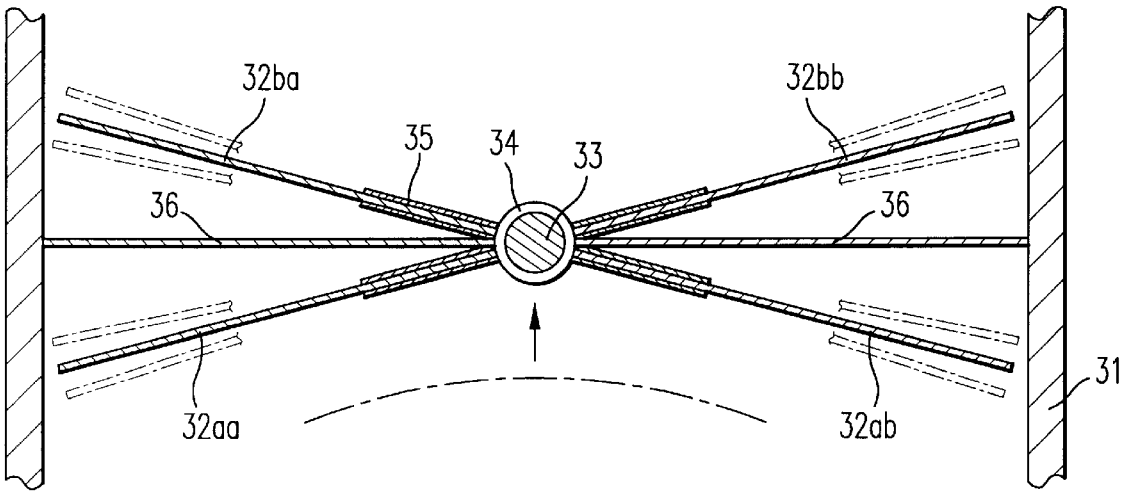
FIG. 22 is a horizontal cross-sectional view of another muffling panel of the present invention (rotating panel type).
Figure 23:
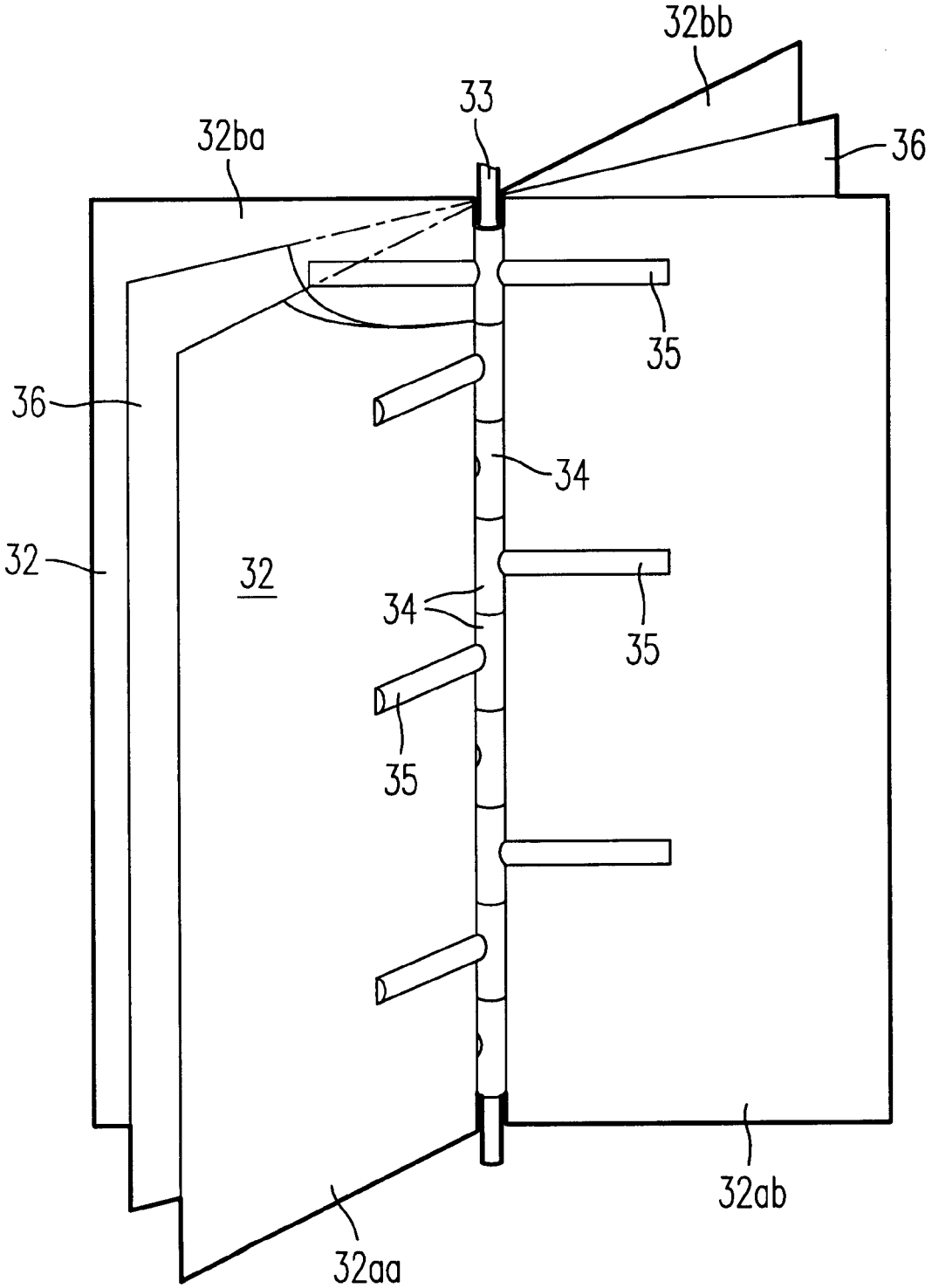
FIG. 23 is an oblique view of the muffling panel of FIG. 22.
Figure 24:
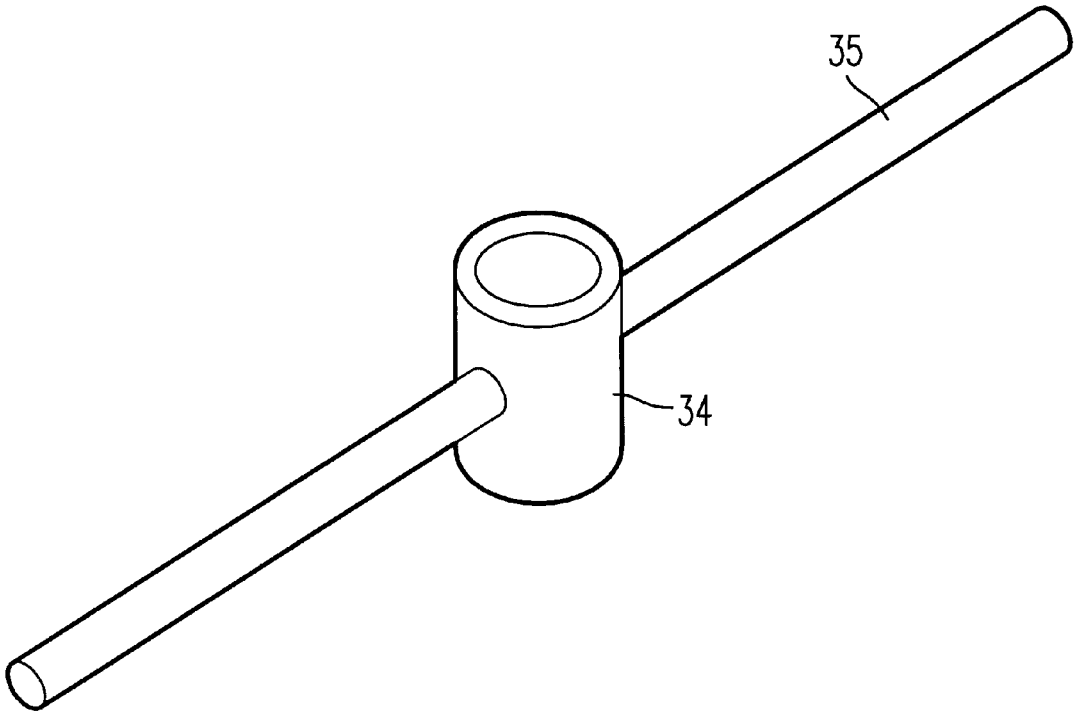
FIG. 24 is an enlarged view of an element of FIG. 23.

FIGS. 22–24 show an embodiment of a rotating panel system.

As shown in FIGS. 22 and 23, a support 33 is set up in the center of a frame body 31, and a number of cylinders 34 are supported in a freely rotating manner by this support. As shown in FIG. 24, two arms 35 extend in opposite directions from a cylinder 34, and this arm is used to mount a diaphragm (panel). There are a total of four diaphragms, and diaphragm 32*bb* is provided so as to extend in the opposite direction from diaphragm 32*aa* with the support 33 therebetween, and diaphragm 32*ba* is provided so as to extend in the opposite direction from diaphragm 32*ab* with the support 33 therebetween, respectively. These diaphragms are mounted so as to be able the rotate around the support 33. A partitioning panel 36 is provided between the diaphragms for preventing interference, and the outer edges thereof are affixed to the frame body 31.

The operation of this muffling panel is explained below.

When a low sound arrives from the direction indicated by the arrow in FIG. 22, the sound strikes diaphragms 32*aa*, 32*ab*, and these diaphragms oscillate around the support 33, as indicated by the chain line in the figure. When diaphragm 32*aa* vibrates, diaphragm 32*bb* connected thereto also vibrates. Similarly, when diaphragm 32*ab* vibrates, diaphragm 32*ba* also vibrates. The diaphragms 32*ba*, 32*bb* on the opposite side of the sound source vibrate at the opposite phase from the sound-source-side diaphragms 32*aa*, 32*ab*, and produce a muffling effect similar to the above-described embodiment.

As described in detail above, the following effects are achieved in accordance with the present invention.

(1) a muffling panel, having high muffling characteristics at a relatively low frequency band area, is achieved.

(2) a new type muffling panel, having a lightweight structure, and having a function for effectively isolating at a high level a sound in low and medium sound ranges, is achieved.

(3) a muffling panel of lightweight construction, which is useful in the walls and floors of structures and buildings, sound absorbing walls in hallways, sound insulating walls along railroad tracks/expressways, and soundproofing walls for machinery, engine rooms, and noise eliminators (mufflers) for internal combustion engines or the like, can be provided.

(4) a muffling panel of lightweight construction, having a simple structure, being inexpensive to manufacture, and moreover, being capable of being installed in a short period of time, can be provided.

(5) this invention facilitates the unitization, standardization of a muffling mechanism, and facilitates the mass production of a muffling panel equipped with the unit of this muffling mechanism.

(6) In accordance with the above-mentioned unitization, this unit of the muffling mechanism can be readily incorporated into structures, buildings, and other products.

What is claimed is:

1. A muffling panel of lightweight construction, having high muffling and sound-absorbing properties in a relatively low frequency band area, which comprises, (a) two opposing diaphragms;

(b) a frame body for affixing these diaphragms; and (c) a mechanical type opposite phase vibration transmitting mechanism for linking these diaphragms so they communicate with one another, wherein said vibration transmitting mechanism is constituted so as to transmit a vibration of a diaphragm of the one side, which vibrates upon receiving a sound, to a diaphragm of the other side by mechanically changing same to an opposite (reverse) phase vibration to cause the diaphragm of the other side to displace inward or outward, and vibrate simultaneously with the diaphragm of the one side in accordance with original sound vibration energy.

2. The muffling panel according to claim 1, wherein the vibration transmitting mechanism comprises an apparatus (transmitter), which is supported in the middle in a freely rotating manner at a fixed point between two diaphragms, and each end thereof is linked to a corresponding diaphragm.

3. The muffling panel according to claim 2, wherein said transmitter comprises an oscillating link and secondary links, the oscillating link is supported in the middle in a freely rotating manner at a fixed point between two diaphragms, the secondary links are hinged, respectively, to both ends of this oscillating link, and the end of this secondary link is linked to a corresponding diaphragm.

4. The muffling panel according to claim 3, wherein said secondary link comprises a filament body, both ends of said oscillating link are connected to corresponding diaphragms via this filament body, and this oscillating link is biased by a bias spring so as to apply tensile force to this filament body.

5. The muffling panel according to claim 1 or 2, wherein the frame body comprises a grate having a plurality of compartments, a diaphragm is affixed to both sides of this grate, two opposing diaphragms are formed in each compartment, and the vibration transmitting mechanism links a diaphragm of one side of one of the compartments of the grate to a diaphragm of the other side of an adjacent compartment so they communicate with one another.

6. The muffling panel according to claim 2, wherein said transmitter comprises at least two main links, which are hinged together and are linked at each end thereof to a corresponding diaphragm, and at least two secondary links, each end of which is hinged to a midpoint of a corresponding main link, and these main links and secondary links act in concert, constituting parallel links.

7. The muffling panel according to claim 1 or 2, wherein two diaphragms formed in the shape of trumpets are mounted to the opening portions of both sides of a box body, which is partitioned in the middle by a partitioning panel.

8. The muffling panel according to claim 1, wherein the vibration transmitting mechanism comprises two pistons-cylinders, the insides of which are filled with fluid, and the piston, which fits into each cylinder, is connected to a corresponding diaphragm, and both cylinders are linked together so that when the piston of one side moves, the piston of the other side moves in the opposite direction.

9. A muffling panel of lightweight construction, having high muffling properties in a relatively low frequency band area, which comprises two diaphragms characterized in that a side edge of each of two diaphragms is supported on a spindle in a freely rotating manner, and furthermore, a diaphragm that moves in unison with these diaphragms is provided so as to extend on the opposite side thereof with this spindle in between, and, a partitioning panel is formed between said two diaphragms.

* * * * *